US010913104B2

(12) United States Patent
Gurunath

(10) Patent No.: US 10,913,104 B2
(45) Date of Patent: Feb. 9, 2021

(54) NANOPARTICLE BASED SAND CONDITIONER COMPOSITION AND A METHOD OF SYNTHESIZING THE SAME

(71) Applicant: Vijay Gurunath, Bangalore (IN)

(72) Inventor: Vijay Gurunath, Bangalore (IN)

(73) Assignee: Vijay Gurunath, Bangalore (IN)

( * ) Notice: Subject to any disclaimer, the term of this patent is extended or adjusted under 35 U.S.C. 154(b) by 239 days.

(21) Appl. No.: 16/063,238

(22) PCT Filed: Nov. 30, 2016

(86) PCT No.: PCT/IN2016/000281
§ 371 (c)(1),
(2) Date: Jun. 15, 2018

(87) PCT Pub. No.: WO2017/103938
PCT Pub. Date: Jun. 22, 2017

(65) Prior Publication Data

US 2018/0369899 A1 Dec. 27, 2018

(30) Foreign Application Priority Data

Dec. 15, 2015 (IN) ..... 6921/CHE/2015

(51) Int. Cl.
*B22C 1/16* (2006.01)
*B22C 1/02* (2006.01)
*B22C 1/22* (2006.01)

(52) U.S. Cl.
CPC ..... *B22C 1/167* (2013.01); *B22C 1/02* (2013.01); *B22C 1/16* (2013.01); *B22C 1/22* (2013.01)

(58) Field of Classification Search
CPC .. B22C 1/02; B22C 1/16; B22C 1/167; B22C 1/22
USPC ..... 164/15, 520, 529; 106/38.2, 38.22, 106/38.27, 38.28, 38.9
See application file for complete search history.

(56) References Cited

U.S. PATENT DOCUMENTS 4,137,085 A * 1/1979 Matsui ..... B22C 1/00 106/38.3
9,038,708 B1 * 5/2015 Hoffman, Jr. et al. ... B22C 1/02 164/526

* cited by examiner

*Primary Examiner* — Kevin P Kerns
(74) *Attorney, Agent, or Firm* — Barry Choobin; Patent 360 LLC

(57) ABSTRACT

The present invention relates to nanoparticle based sand conditioner composition and a method of synthesizing the same. The composition has the raw material compound RM 1, RM 2, RM 3 and RM 4. The RM1 has carbonaceous material, hydrocarbons, ultrafine metal/metal oxide and ceramic oxide nanoparticles and metallic wires. The RM 2 has natural carbon source. The RM 3 comprises synthetic/non-renewable carbon source. The RM 4 has hydrocarbons. The method of synthesizing nanoparticle based sand conditioner comprises mixing RM 2 and RM 4 in a mixer for 10 minutes for coating RM 2 with RM 4 to obtain an intermediate product. The RM 1 and RM 3 are added to an intermediate product in a mixer and mixed for 10 minutes to get a uniform/homogeneous mixture which is cooled to obtain a sand conditioner composition impregnated with nanoparticles into carbon.

20 Claims, 14 Drawing Sheets

NANOPARTICLE BASED SAND CONDITIONER COMPOSITION AND A METHOD OF SYNTHESIZING THE SAME

CROSS REFERENCE TO RELATED APPLICATIONS

This patent application is a National Phase Application corresponding to the PCT Application No. PCT/IN2016/000281 filed on Nov. 30, 2016 with the title "NANOPARTICLE BASED SAND CONDITIONER COMPOSITION AND A METHOD OF SYNTHESIZING THE SAME". This patent application claims the priority of the Indian Provisional Patent Application No. 6921/CHE/2015 filed on Dec. 15, 2015 with the title "NANOPARTICLE BASED SAND CONDITIONER COMPOSITION AND A METHOD OF SYNTHESIZING THE SAME", the contents of which is included herein by the way of reference.

BACKGROUND

Technical Field

The present invention is generally related to the foundry industry. The present invention is particularly related to the sand mould for casting metal in the foundry industry. The present invention is more particularly related to a sand mold composition comprising ceramic and metal nanoparticles impregnated into carbon for casting in green sand ferrous foundry.

Description of the Related Art

A foundry is used for producing metal castings. Metals are cast into shapes by melting them into a liquid, pouring the molten metal in a mould and removing the mould material or casting after the metal has solidified due to cooling. In this process, the molten metal is solidified and metal parts of the desired shapes and sizes are formed.

Foundry is classified according to the metals, or alloys made. The molten metals are casted into various shapes and sizes. For casting molten metals and casting/mould patterns are used. There are several casting/moulding processes commonly used in the foundry industry. The casting processes commonly used in foundry industry are sand casting, lost foam casting, investment casting, ceramic mold casting, V-process casting, die casting, and billet (ingot) casting.

In the casting process, a pattern of cast is made in the shape of the desired part. Simple designs are made in a single piece or solid pattern. More complex designs are made in two parts, called split patterns. A split pattern has a top or upper section, called as "cope", and a bottom or lower section called as "drag". Both solid and split patterns can have cores inserted to complete the final part shape. Cores are used to create hollow areas in the mold. The cope and drag sections are separated by an area called "parting line". The solid and split cast patterns are made out of wood, wax, plastic or metal.

The molds are constructed by several different processes depending upon the type of foundry, metal to be poured, quantity of parts to be produced, size of the castings and complexity of the castings. These mold processes include: (1) Sand casting—Green or resin bonded sand mold, (2) Lost-foam casting—polystyrene pattern with a mixture of ceramic and sand mold, (3) Investment castings—wax or similar sacrificial pattern with a ceramic mold, (4) Ceramic mold castings—plaster mold, (5) V-process castings—vacuum is used in conjunction with thermoformed plastic to form sand molds; and no moisture, clay or resin is needed for sand to retain shape, (6) Die castings—Metal mold, (7) Billet (ingot) casting—Simple mold for producing ingots of metal normally for use in other foundries.

Sand casting is one of the earliest forms of casting practiced due to the simplicity of materials involved and still remains as one of the cheapest ways to cast metals due to simplicity.

Almost 99% of the foundries uses and to make casts. The types of binders used in sand moulds are bentonite, fast curing adhesives, organic and inorganic resins, etc. Approximately 75% of world foundries use green sand with bentonite for castings.

Green sand is usually housed in what casters refer to as casting flasks, which are nothing other than boxes without a bottom or lid. The box is split into two halves which are stacked together in use. The halves are referred to as the top (cope) and bottom (drag) flask respectively. Not all Green sand used is green in color. The term "green" is used to indicate that the sand is used in a wet state.

There are currently two hypothesis accepted in the foundry industry. These hypotheses define the interaction between the molten metal and the sand mould. The first hypothesis is known as "Lustrous Carbon Hypothesis". According to this hypothesis, a thin layer of lustrous carbon is formed between the molten metal and the sand. This barrier reduces the interaction between the molten metal and sand.

The second hypothesis is known as "Gas Cushion Hypothesis". According to this hypothesis, the carbon present in the additive burns and forms a gas cushion between the molten metal and sand, thereby acting as a barrier.

There is no clear understanding about the interaction between the molten metal and the sand mould. This has created a void in the understanding and development of green sand. Current products are either low-ash coal dust based or petroleum pitch based products.

Green sand foundries contribute about 75% to all castings produced. Green sand is an aggregate of sand, bentonite clay, pulverized coal/petroleum pitch and water. Green sand is mainly used in making molds for metal castings. The largest portion of the aggregate is always sand, which is either silica or olivine. There are many compositions for the proportion of clay, but the compositions show different balances between moldability, surface finish, and ability of the hot molten metal to degas.

In iron foundries, silica in castings needs space for expansion. The silica fuses with molten iron at temperatures greater than 1440° C.

Carbon additive is added to avoid silica fusing with molten iron. The common carbon sources are coal dust and pitch. The pitch in the castings again has disadvantages. Pitch softens at higher temperatures and clogs conveyer belt and feeding mechanisms. Softened Pitch binds the sand making it difficult to re-use the sand.

Wood floor and oil are added in the castings to overcome the problem of the silica and pitch. The wood floor and oil mixture in the casting composition again has disadvantages. Further the coal powder is used in the casting composition. But coal powder has disadvantage of catching fire. Also the coal powder varies with batches and hence the composition is not consistent. Further ash build up is more in the case of coal powder. Ash also fuses with molten metal. The fusion of ash with molten metal contaminates the molten metal and causes severe rejections in the castings produced.

Hence, there is a need for a composition comprising nanoparticles impregnated into carbon to form a non-wetting layer between the molten metal and sand at extreme temperatures. Also, there is a need for a method to synthesize the sand mould comprising nanoparticles impregnated into carbon.

OBJECTIVES OF THE EMBODIMENTS

The primary objective of the present invention is to provide a composition comprising nanoparticles impregnated into carbon which forms a non-wetting layer between the molten metal and sand at extreme temperature (more than 1200° C.).

Another objective of the present invention is to provide a method for synthesizing the sand mould comprising nanoparticles impregnated into carbon.

Yet another objective of the present invention is to provide a composition comprising nanoparticles impregnated into carbon to increase the wet tensile strength (WTS) of sand in the sand mould composition.

Yet another objective of the present invention is to provide a composition comprising nanoparticles impregnated into carbon to provide resistant to expansion defects (scabbing and rat tail).

Yet another objective of the present invention is to provide a composition comprising nanoparticles impregnated into carbon to eliminate metal penetration and burn-on/burn-in defects.

Yet another objective of the present invention is to provide a nanoparticles impregnated sand conditioner composition to reduce scabbing, hot-tear and hot-crack casting defects.

Yet another objective of the present invention is to provide a nanoparticle based sand conditioner composition to improve collapsibility and reduce shake out time.

Yet another objective of the present invention is to provide a nanoparticle based sand conditioner composition which reduces sand loss and avoids lumping during shake out.

Yet another objective of the present invention is to provide a nanoparticle based sand conditioner composition to improve refractoriness and permeability.

Yet another objective of the present invention is to provide a nanoparticle based sand conditioner composition which is easily stored.

Yet another objective of the present invention is to provide a nanoparticle based sand conditioner composition which improves/elevates the flow-ability of green sand at extreme temperatures.

Yet another objective of the present invention is to provide a nanoparticle based sand conditioner composition which provides improved sand peel and surface finish when compared to existing sand mould compositions.

Yet another objective of the present invention is to provide a nanoparticle based sand conditioner composition to reduce a consumption of bentonite in the sand mould composition.

Yet another objective of the present invention is to provide a nanoparticle based sand conditioner composition to eliminate/reduce/remediate halogen contamination in the sand.

Yet another objective of the present invention is to provide a nanoparticle based sand conditioner composition to eliminate/reduce erosion and expansion scabs.

Yet another objective of the present invention is to provide a nanoparticle based sand conditioner composition to increase oxidation of carbon monoxide and to reduce the harmful carbon monoxide emissions.

Yet another objective of the present invention is to provide a nanoparticle based sand conditioner composition to increase a shatter index.

These and other objects and advantages of the present invention will become readily apparent from the following detailed description taken in conjunction with the accompanying drawings.

SUMMARY

The various embodiments herein provide a composition comprising nanoparticles impregnated into carbon to form a non-wetting layer between the molten metal and sand at extreme temperature. The embodiments of the present invention also provide a method to synthesize the sand mould composition comprising nanoparticles impregnated into carbon.

According to one embodiment herein, a nanoparticle based sand conditioner composition for foundry industry comprises a raw material compound 1, a raw material compound 2, a raw material compound 3 and a raw material compound 4. The raw material compound 1 comprises carbonaceous material, hydrocarbon, ultrafine metal/metal oxide compound nanoparticles, ultrafine ceramic oxide nanoparticles and metallic wires.

According to one embodiment herein, an amount of carbonaceous material present in the raw material compound 1 is 85-98% w/w. An amount of hydrocarbon present in the raw material compound 1 is 2-10% w/w. An amount of ultrafine metal/metal oxide compound nanoparticles present in the raw material compound 1 is 1-10% w/w. An amount of ultrafine ceramic oxide nanoparticles present in the raw material compound 1 is 1-10% w/w. An amount of metallic wires present in the raw material compound 1 is lesser than or equal to 2% w/w.

According to one embodiment herein, the raw material compound 2 comprises carbon source or natural carbon source. The natural carbon source is selected from a group consisting of saw dust, coffee husk, rice/paddy husk, tamarind seed husk and other similar materials. The volatile matter present in the raw material compound 2 is in a quantity of more than 70% w/w. An ash content in the raw material compound 2 is less than 3% w/w. A moisture content in the raw material compound 2 is less than 5% w/w. A particle size of raw material compound 2 is within a range of −20 mesh to +100 mesh or Standard BSS mesh.

According to one embodiment herein, the raw material compound 3 comprises carbon source or synthetic or non-renewable sources. The synthetic or non-renewable carbon source is selected from a group consisting of coal dust, graphite, pitch powder, calcined petroleum coke (CPC) or other similar materials. An ash content in the raw material compound 3 is less than 3% w/w. A volatile matter present in the raw material compound 3 is more than 10% w/w. A moisture content in the raw material compound 3 is less than 5% w/w.

According to one embodiment herein, the raw material compound 4 comprises hydrocarbons. The hydrocarbons are selected from the group consisting of C5 to C36 compounds. An ash content in the raw material compound 4 is less than 0.05% w/w. A volatile matter present in the raw material compound 4 is more than 90% w/w. A moisture content in the raw material compound 4 is less than 5% w/w.

According to one embodiment herein, the nanoparticle based sand conditioner composition for foundry industry comprises nanoparticles impregnated into carbon in a sand mould.

According to one embodiment herein, the carbonaceous material is selected from a group consisting of lamp black, and/or furnace black. The carbonaceous material comprises a carbon, a hydrogen and an ash. An amount of carbon present in the carbonaceous material is within a range of 80-95%. An amount of hydrogen present in the carbonaceous material is within a range of 1.6-3%. An amount of ash present in the carbonaceous material is 2% w/w. A particle size of carbonaceous material is less than 1.2 mm. A softening point of the carbonaceous material is more than 110° C. An amount of volatile matter present in the carbonaceous material is more than 50% w/w. A moisture content in the carbonaceous material is less than 8%.

According to one embodiment herein, the hydrocarbon is selected from a group consisting of C5 to C36 compounds. An amount of ash present in the hydrocarbon is less than 0.05% w/w. An amount of volatile matter present in the hydrocarbon is more than 90% w/w. An amount of moisture present in the hydrocarbon is less than 5% w/w.

According to one embodiment herein, the ultrafine metal/metal oxide compound nanoparticle is selected from a group consisting of $CuFe_2O_4$, $CoFe_2O_4$, $ZnFe_2O_4$, $CuZnFe_2O_4$, $Fe_2O_3$, Gamma $Fe_2O_3$, $Fe_3O_4$, ZnO. A particle size of the ultrafine metal or metal oxide compound nanoparticle is less than 0.1 microns. A melting point of ultrafine metal or metal oxide compound nanoparticle is greater than 1000° C.

According to one embodiment herein, the ultrafine ceramic oxide nanoparticles are selected from a group consisting of alumina, beryllia, ceria, zirconia, silica/silica fume or fused silica. A particle size of the ultrafine ceramic oxide nanoparticles is less than 0.1 micron.

According to one embodiment herein, an amount of graphene present in the raw material compound 1 is less than 1% w/w. An amount of volatile matter present in the raw material compound 1 is less than 15% w/w. The carbon component of carbonaceous material has a structure similar to graphite with covalent bonds. The carbon component is impregnated with the nano-ceramic oxides and nano metal oxides. An amount of ash present in the raw material compound 1 is 30% w/w. Specifically the amount of ash present in the raw material compound 1 is within a range of 9-16% w/w. The raw material compound 1 exhibits flowability at a temperature of 926° C.

According to one embodiment herein, a molecular composition of raw material compound 1 comprises carbon, hydrogen, nitrogen, oxygen, silica, zinc, iron, titanium, aluminum, sodium, potassium, magnesium and copper. An amount of the carbon present in the molecular composition of raw material compound 1 is 80-88%. The hydrogen is present in the molecular composition of raw material compound 1 in a quantity of 1.5-2%. The nitrogen is present in the molecular composition of raw material compound 1 in a quantity of 0.3-0.4%. The oxygen is present in the molecular composition of raw material compound 1 in a quantity of less than 3%. The silica is present in the molecular composition of raw material compound 1 in a quantity of less than 3%. The zinc is present in the molecular composition of raw material compound 1 in a quantity of 3-4%. The iron is present in the molecular composition of raw material compound 1 in a quantity of 3-5%. The titanium, aluminum, sodium, potassium, magnesium, and copper together are present in the molecular composition of raw material compound 1 in a quantity less than 2%.

According to one embodiment herein, the metallic wires are made from the metals or alloys selected from a group consisting of, iron, alloys of iron, steel or alloys of steel, and the metallic wires have a diameter in a range of 0-1.2 mm. The metallic wires have a length in a range of 0-3 mm. The metallic wires form an intermediate compound. The intermediate compound comprises carbon particles, metal particles and ceramic particles.

According to one embodiment herein, a method of synthesizing a nanoparticle based sand conditioner composition for foundry industry is provided. The method comprises the following steps. A raw material compound 1 is synthesized. Further a raw material compound 2 and a raw material compound 4 are mixed in a mixer for 10 minutes until the raw material compound 4 is uniformly coated over raw material compound 2. The raw material compound 2 and the raw material compound 4 are mixed to obtain an intermediate product. The raw material compound 1 and a raw material compound 3 are mixed to the intermediate product in a mixer for 10 minutes to obtain a uniform mixture. The nanoparticle based sand conditioner composition for foundry industry is obtained. The nanoparticle based sand conditioner composition for foundry industry comprises nanoparticles impregnated into carbon in a sand mould. The nanoparticle based sand conditioner composition for foundry industry is packaged or bagged.

According to one embodiment herein, the raw material compound 1 comprises carbonaceous material, hydrocarbon, ultrafine metal/metal oxide compound nanoparticles, ultrafine ceramic oxide nanoparticles and metallic wires. An amount of carbonaceous material present in the raw material compound 1 is 85-98% w/w. An amount of hydrocarbon present in the raw material compound 1 is 2-10% w/w. An amount of ultrafine metal/metal oxide compound nanoparticles present in the raw material compound 1 is 1-10% w/w. The ultrafine ceramic oxide nanoparticles present in the raw material compound 1 is 1-10% w/w. An amount of metallic wires present in the raw material compound 1 is 2% w/w. The raw material compound 2 comprises carbon source or natural carbon source. The natural carbon source is selected from a group consisting of saw dust, coffee husk, rice/paddy husk and tamarind seed husk and other similar materials. The raw material compound 3 comprises carbon source or synthetic carbon source or non-renewable carbon source. The synthetic or non-renewable carbon source is selected from a group consisting of coal dust, graphite, pitch powder and calcined petroleum coke (CPC) and other similar materials. The raw material compound 4 comprises hydrocarbons. The hydrocarbons are selected from a group consisting of C5 to C36 compounds.

According to one embodiment herein, the method of synthesizing the raw material compound 1 comprises the following steps. The carbonaceous material, the hydrocarbon, the ultrafine metal/metal oxide compound nanoparticles, an ultrafine ceramic oxide nanoparticles and metal wires are mixed to obtain a mixture. The mixture is heated at a temperature of 200-500° C. with constant agitation for 1 hour in a reactor at a pressure of 0.3 bar to 45 bar. The temperature of the heated mixture is maintained for 8-24 hours with constant agitation in the reactor. The reaction is terminated after 8-24 hours by stopping heat supply. The air at ambient temperature is passed through the mixture in the reactor and the agitation of the reactor with the mixture is continued to cool the mixture to a room temperature or a temperature of 50° C. to obtain the raw material compound 1. The raw material compound 1 is packaged or bagged.

According to one embodiment herein, the carbonaceous material is selected from a group consisting of lamp black, and/or furnace black. A particle size of carbonaceous material is less than 1.2 mm. A softening point of the carbonaceous material is more than 110° C. An amount of volatile matter present in the carbonaceous material is more than 50% w/w. A moisture content in the carbonaceous material is less than 8%. The carbonaceous material comprises carbon, hydrogen and ash. An amount of carbon present in the carbonaceous material is within a range of 80-95%. An amount of hydrogen present in the carbonaceous material is within a range of 1.6-3%. An amount of ash present in the carbonaceous material is 2% w/w.

According to one embodiment herein, an amount of ash present in the hydrocarbon is less than 0.05% w/w. An amount of volatile matter present in the hydrocarbon is more than 90% w/w. An amount of moisture present in the hydrocarbon is less than 5% w/w.

According to one embodiment herein, the ultrafine metal/metal oxide compound nanoparticles are selected from a group consisting of $CuFe_2O_4$, $CoFe_2O_4$, $ZnFe_2O_4$, $CuZnFe_2O_4$, $Fe_2O_3$, Gamma $Fe_2O_3$, $Fe_3O_4$, ZnO. A particle size of the ultrafine metal or metal oxide compound nanoparticles is less than 0.1 microns. A melting point of ultrafine metal or metal oxide compound nanoparticles is more than 1000° C.

According to one embodiment herein, the ultrafine ceramic oxide nanoparticles are selected from a group consisting of alumina, beryllia, ceria, zirconia, silica/silica fume or fused silica. A particle size of the ultrafine ceramic oxide nanoparticles is less than 0.1 micron.

According to one embodiment herein, an amount of graphene present in the raw material compound 1 is less than 1% w/w. An amount of volatile matter present in the raw material compound 1 is less than 15% w/w. The carbon component of the carbonaceous material has a structure similar to graphite with covalent bonds. The carbon component is impregnated with the nano-ceramic oxides and nano metal oxides. An amount of ash present in the raw material compound 1 is 30% w/w, and specifically the ash is present within a range of 9-16% w/w. The raw material compound 1 exhibits flow-ability at a temperature of 926° C.

According to one embodiment herein, the molecular composition of raw material compound 1 comprises carbon, hydrogen, nitrogen, oxygen, silica, zinc, iron, titanium, aluminum, sodium, potassium, magnesium, and copper. The carbon is present in the molecular composition of raw material compound 1 in a quantity of 80-88%. The hydrogen is present in the molecular composition of raw material compound 1 in a quantity of 1.5-2%. The nitrogen is present in the molecular composition of raw material compound 1 in a quantity of 0.3-0.4%. The oxygen is present in the molecular composition of raw material compound 1 in a quantity of less than 3%. The silica is present in the molecular composition of raw material compound 1 in a quantity of less than 3%. The zinc is present in the molecular composition of raw material compound 1 in a quantity of 3-4%. The iron is present in the molecular composition of raw material compound 1 in a quantity of 3-5%. The titanium, aluminum, sodium, potassium, magnesium, and copper together are present in the molecular composition of raw material compound 1 in a quantity less than 2%.

According to one embodiment herein, the metallic wires are made from the metals or alloys selected from a group consisting of, iron, alloys of iron, steel or alloys of steel. The metallic wires have a diameter within a range of 0-1.2 mm. The metallic wires have a length in a range of 0-3 mm. The metallic wires form an intermediate compound. The intermediate compound comprises carbon particles, metal particles and ceramic particles.

According to one embodiment herein, the raw material compound 2 is present in a quantity of more than 70% w/w. An amount of ash present in the raw material compound 2 is less than 3% w/w. An amount of moisture present in the raw material compound 2 is less than 5% w/w. An amount of ash present in the raw material compound 2 is less than 3% w/w. A particle size for raw material compound 2 is within a range of −20 mesh to +100 mesh or Standard BSS Mesh.

According to one embodiment herein, an amount of ash present in the raw material compound 3 is less than 3% w/w. An amount of volatile matter present in the raw material compound 3 is more than 10% w/w. An amount of moisture content present in the raw material compound 3 is less than 5% w/w.

According to one embodiment herein, an amount of ash present in the raw material compound 4 is less than 0.05% w/w. An amount of volatile matter present in the raw material compound 4 is more than 90% w/w. An amount of moisture content present in the raw material compound 4 is less than 5% w/w.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
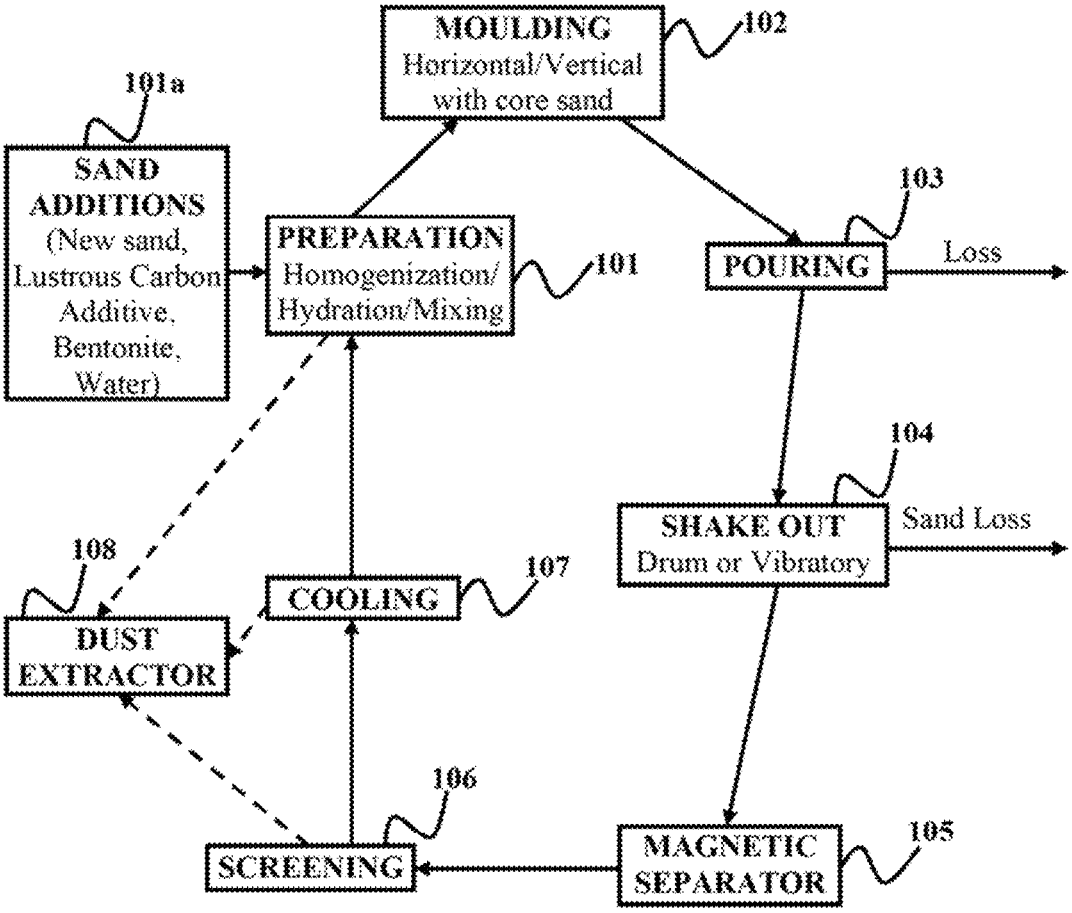
FIG. 1 illustrates a process flow diagram indicating the steps of processes followed in a sand casting method in a foundry, according to an embodiment herein.

Although the specific features of the present invention are shown in some drawings and not in others. This is done for convenience only as each feature may be combined with any or all of the other features in accordance with the present invention.

DETAILED DESCRIPTION OF THE EMBODIMENTS HEREIN

In the following detailed description, reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a composition comprising nanoparticles impregnated into carbon to form a non-wetting layer between the molten metal and sand at extreme temperature. The embodiments of the present invention also provide a method to synthesize the sand mould composition comprising nanoparticles impregnated into carbon.

According to one embodiment herein, a nanoparticle based sand conditioner composition for foundry industry comprises a raw material compound 1, a raw material compound 2, a raw material compound 3 and a raw material compound 4. The raw material compound 1 comprises carbonaceous material, hydrocarbon, ultrafine metal/metal oxide compound nanoparticles, ultrafine ceramic oxide nanoparticles and metallic wires.

According to one embodiment herein, an amount of carbonaceous material present in the raw material compound 1 is 85-98% w/w. An amount of hydrocarbon present in the raw material compound 1 is 2-10% w/w. An amount of ultrafine metal/metal oxide compound nanoparticles present in the raw material compound 1 is 1-10% w/w. An amount of ultrafine ceramic oxide nanoparticles present in the raw material compound 1 is 1-10% w/w. An amount of metallic wires present in the raw material compound 1 is 2% w/w.

According to one embodiment herein, the raw material compound 2 comprises carbon source or natural carbon source. The natural carbon source is selected from a group consisting of saw dust, coffee husk, rice/paddy husk and tamarind seed husk and other similar materials. The raw material compound 2 is present in a quantity of more than 70% w/w. An ash content in the raw material compound 2 is less than 3% w/w. A moisture content in the raw material compound 2 is less than 5% w/w. A particle size of raw material compound 2 is within a range of −20 mesh to +100 mesh or Standard BSS Mesh.

According to one embodiment herein, the raw material compound 3 comprises carbon source or synthetic or non-renewable sources. The synthetic or non-renewable carbon source is selected from a group consisting of coal dust, graphite, pitch powder and calcined petroleum coke (CPC) and other similar materials. An ash content in the raw material compound 3 is less than 3% w/w. A volatile matter present in the raw material compound 3 is more than 10% w/w. A moisture content in the raw material compound 3 is less than 5% w/w.

According to one embodiment herein, the raw material compound 4 comprises hydrocarbons. The hydrocarbons are selected from the group consisting of C5 to C36 compounds. An ash content in the raw material compound 4 is less than 0.05% w/w. A volatile matter present in the raw material compound 4 is more than 90% w/w. A moisture content in the raw material compound 4 is less than 5% w/w.

According to one embodiment herein, the nanoparticle based sand conditioner composition for foundry industry comprises nanoparticles impregnated into carbon in a sand mould.

According to one embodiment herein, the carbonaceous material is selected from a group consisting of lamp black, and/or furnace black. The carbonaceous material comprises a carbon, a hydrogen and an ash. An amount of carbon present in the carbonaceous material is within a range of 80-95%. An amount of hydrogen present in the carbonaceous material is within a range of 1.6-3%. An amount of ash present in the carbonaceous material is 2% w/w. A particle size of carbonaceous material is less than 1.2 mm. A softening point of the carbonaceous material is more than 110° C. An amount of volatile matter present in the carbonaceous material is more than 50% w/w. A moisture content in the carbonaceous material is less than 8%.

According to one embodiment herein, the hydrocarbon is selected from a group consisting of C5 to C36 compounds. An amount of ash present in the hydrocarbon is less than 0.05% w/w. An amount of volatile matter present in the hydrocarbon is more than 90% w/w. An amount of moisture present in the hydrocarbon is less than 5% w/w.

According to one embodiment herein, the ultrafine metal/metal oxide compound nanoparticle is selected from a group consisting of $CuFe_2O_4$, $CoFe_2O_4$, $ZnFe_2O_4$, $CuZnFe_2O_4$, $Fe_2O_3$, Gamma $Fe_2O_3$, $Fe_3O_4$, ZnO. A particle size of the ultrafine metal or metal oxide compound nanoparticle is less than 0.1 microns. A melting point of ultrafine metal or metal oxide compound nanoparticle is 1000° C.

According to one embodiment herein, the ultrafine ceramic oxide nanoparticles are selected from a group consisting of alumina, beryllia, ceria, zirconia, silica/silica fume or fused silica. A particle size of the ultrafine ceramic oxide nanoparticles is less than 0.1 micron.

According to one embodiment herein, an amount of graphene present in the raw material compound 1 is less than 1% w/w. An amount of volatile matter present in the raw material compound 1 is less than 15% w/w. The carbon component of carbonaceous material has a structure similar to graphite with covalent bonds. The carbon component is impregnated with the nano-ceramic oxides and nano metal oxides. An amount of ash present in the raw material compound 1 is 30% w/w. Specifically the amount of ash present in the raw material compound 1 is within a range of 9-16% w/w. The raw material compound 1 exhibits flowability at a temperature of 926° C.

According to one embodiment herein, a molecular composition of raw material compound 1 comprises carbon, hydrogen, nitrogen, oxygen, silica, zinc, iron, titanium, aluminum, sodium, potassium, magnesium and copper. An amount of the carbon present in the molecular composition of raw material compound 1 is 80-88%. The hydrogen is present in the molecular composition of raw material compound 1 in a quantity of 1.5-2%. The nitrogen is present in the molecular composition of raw material compound 1 in a quantity of 0.3-0.4%. The oxygen is present in the molecular composition of raw material compound 1 in a quantity of less than 3%. The silica is present in the molecular composition of raw material compound 1 in a quantity of less than 3%. The zinc is present in the molecular composition of raw material compound 1 in a quantity of 3-4%. The iron is present in the molecular composition of raw material compound 1 in a quantity of 3-5%. The titanium, aluminum, sodium, potassium, magnesium, and copper together are present in the molecular composition of raw material compound 1 in a quantity less than 2%.

According to one embodiment herein, the metallic wires are made from the metals or alloys selected from a group consisting of, iron, alloys of iron, steel or alloys of steel, and the metallic wires have a diameter in a range of 0-1.2 mm. The metallic wires have a length in a range of 0-3 mm. The metallic wires form an intermediate compound. The intermediate compound comprises carbon particles, metal particles and ceramic particles.

According to one embodiment herein, a method of synthesizing a nanoparticle based sand conditioner composition for foundry industry is provided. The method comprises the following steps. A raw material compound 1 is synthesized. Further a raw material compound 2 and a raw material compound 4 are mixed in a mixer for 10 minutes until the raw material compound 4 is uniformly coated over raw material compound 2. The raw material compound 2 and the raw material compound 4 are mixed to obtain an intermediate product. The raw material compound 1 and a raw material compound 3 are mixed to the intermediate product in a mixer for 10 minutes to obtain an uniform mixture. The nanoparticle based sand conditioner composition for foundry industry is obtained. The nanoparticle based sand conditioner composition for foundry industry comprises nanoparticles impregnated into carbon in a sand mould. The nanoparticle based sand conditioner composition for foundry industry is packaged or bagged.

According to one embodiment herein, the raw material compound 1 comprises carbonaceous material, hydrocarbon, ultrafine metal/metal oxide compound nanoparticles, ultrafine ceramic oxide nanoparticles and metallic wires. An amount of carbonaceous material present in the raw material compound 1 is 85-98% w/w. An amount of hydrocarbon present in the raw material compound 1 is 2-10% w/w. An amount of ultrafine metal/metal oxide compound nanoparticles present in the raw material compound 1 is 1-10% w/w. The ultrafine ceramic oxide nanoparticles present in the raw material compound 1 is 1-10% w/w. An amount of metallic wires present in the raw material compound 1 is 2% w/w. The raw material compound 2 comprises carbon source or natural carbon source. The natural carbon source is selected from a group consisting of saw dust, coffee husk, rice/paddy husk and tamarind seed husk and other similar materials. The raw material compound 3 comprises carbon source or synthetic carbon source or non-renewable carbon source. The synthetic or non-renewable carbon source is selected from a group consisting of coal dust, graphite, pitch powder and calcined petroleum coke (CPC) and other similar materials. The raw material compound 4 comprises hydrocarbons. The hydrocarbons are selected from a group consisting of C5 to C36 compounds.

According to one embodiment herein, the method of synthesizing the raw material compound 1 comprises the following steps. The carbonaceous material, the hydrocarbon, the ultrafine metal/metal oxide compound nanoparticles, an ultrafine ceramic oxide nanoparticles and metal wires are mixed to obtain a mixture. The mixture is heated at a temperature of 200-500° C. with constant agitation for 1 hour in a reactor at a pressure of 0.3 bar to 45 bar. The temperature of the heated mixture is maintained for 8-24 hours with constant agitation in the reactor. The reaction is terminated after 8-24 hours by stopping heat supply. The air at ambient temperature is passed through the mixture in the reactor and the agitation of the reactor with the mixture is continued to cool the mixture to a room temperature or a temperature of 50° C. to obtain the raw material compound 1. The raw material compound 1 is packaged or bagged.

According to one embodiment herein, the carbonaceous material is selected from a group consisting of lamp black, and/or furnace black. A particle size of carbonaceous material is less than 1.2 mm. A softening point of the carbonaceous material is more than 110° C. An amount of volatile matter present in the carbonaceous material is more than 50% w/w. A moisture content in the carbonaceous material is less than 8%. The carbonaceous material comprises carbon, hydrogen and ash. An amount of carbon present in the carbonaceous material is within a range of 80-95%. An amount of hydrogen present in the carbonaceous material is within a range of 1.6-3%. An amount of ash present in the carbonaceous material is 2% w/w.

According to one embodiment herein, an amount of ash present in the hydrocarbon is less than 0.05% w/w. An amount of volatile matter present in the hydrocarbon is more than 90% w/w. An amount of moisture present in the hydrocarbon is less than 5% w/w.

According to one embodiment herein, the ultrafine metal/metal oxide compound nanoparticles are selected from a group consisting of $CuFe_2O_4$, $CoFe_2O_4$, $ZnFe_2O_4$, $CuZnFe_2O_4$, $Fe_2O_3$, Gamma $Fe_2O_3$, $Fe_3O_4$, ZnO. A particle size of the ultrafine metal or metal oxide compound nanoparticles is less than 0.1 microns. A melting point of ultrafine metal or metal oxide compound nanoparticles is 1000° C.

According to one embodiment herein, the ultrafine ceramic oxide nanoparticles are selected from a group consisting of alumina, beryllia, ceria, zirconia, silica/silica fume or fused silica. A particle size of the ultrafine ceramic oxide nanoparticles is less than 0.1 micron.

According to one embodiment herein, an amount of graphene present in the raw material compound 1 is less than 1% w/w. An amount of volatile matter present in the raw material compound 1 is less than 15% w/w. The carbon component of the carbonaceous material has a structure similar to graphite with covalent bonds. The carbon component is impregnated with the nano-ceramic oxides and nano metal oxides. An amount of ash present in the raw material compound 1 is 30% w/w, and specifically the ash is present within a range of 9-16% w/w. The raw material compound 1 exhibits flow-ability at a temperature of 926° C.

According to one embodiment herein, the molecular composition of raw material compound 1 comprises carbon, hydrogen, nitrogen, oxygen, silica, zinc, iron, titanium, aluminum, sodium, potassium, magnesium, and copper. The carbon is present in the molecular composition of raw material compound 1 in a quantity of 80-88%. The hydrogen is present in the molecular composition of raw material compound 1 in a quantity of 1.5-2%. The nitrogen is present in the molecular composition of raw material compound 1 in a quantity of 0.3-0.4%. The oxygen is present in the molecular composition of raw material compound 1 in a quantity of less than 3%. The silica is present in the molecular composition of raw material compound 1 in a quantity of less than 3%. The zinc is present in the molecular composition of raw material compound 1 in a quantity of 3-4%. The iron is present in the molecular composition of raw material compound 1 in a quantity of 3-5%. The titanium, aluminum, sodium, potassium, magnesium, and copper together are present in the molecular composition of raw material compound 1 in a quantity less than 2%.

According to one embodiment herein, the metallic wires are made from the metals or alloys selected from a group consisting of, iron, alloys of iron, steel or alloys of steel. The metallic wires have a diameter within a range of 0-1.2 mm. The metallic wires have a length in a range of 0-3 mm. The metallic wires form an intermediate compound. The intermediate compound comprises carbon particles, metal particles and ceramic particles.

According to one embodiment herein, the raw material compound 2 is present in a quantity of more than 70% w/w. An amount of ash present in the raw material compound 2 is less than 3% w/w. An amount of moisture present in the raw material compound 2 is less than 5% w/w. An amount of ash present in the raw material compound 2 is less than 3% w/w. A particle size for raw material compound 2 is within a range of −20 mesh to +100 mesh.

According to one embodiment herein, an amount of ash present in the raw material compound 3 is less than 3% w/w. An amount of volatile matter present in the raw material compound 3 is more than 10% w/w. An amount of moisture content present in the raw material compound 3 is less than 5% w/w.

According to one embodiment herein, an amount of ash present in the raw material compound 4 is less than 0.05% w/w. An amount of volatile matter present in the raw material compound 4 is more than 90% w/w. An amount of moisture content present in the raw material compound 4 is less than 5% w/w.

According to one embodiment herein, the composition comprising nanoparticles impregnated into carbon comprises of the raw material compound 1, raw material compound 2, raw material compound 3 and raw material compound 4.

According to one embodiment herein, the raw material compound comprises carbonaceous material, hydrocarbons, ultrafine metal/metal compound oxide (nanoparticles), ultrafine ceramic oxide (nanoparticles), and metallic wires.

According to one embodiment herein, the raw material compound 2 comprises carbon source, mainly natural carbon source or cellulose based carbon source.

According to one embodiment herein, the raw material compound 3 comprises carbon source, mainly synthetic or non-renewable sources.

According to one embodiment herein, the raw material compound 4 comprises hydrocarbons.

According to one embodiment herein, the carbonaceous material is present in the raw material compound 1 in a range of 85-98% w/w. Following are the properties of the carbonaceous material. The carbonaceous material is para-crystalline carbon with high surface area to volume ratio. The carbonaceous material is basically carbon with amorphous quasi-graphitic molecular structure. The carbonaceous material is ultrafine particulate aggregate of carbon particles/nanoparticles or mesoparticles or fibers. The particle size of the carbonaceous material is less than 1.2 mm. The softening point of the carbonaceous material is more than 110° C. The volatile matter of the carbonaceous material is more than 50% w/w. The moisture content in the carbonaceous material is less than 8%. The composition of the carbonaceous material comprises carbon, hydrogen and ash. The carbon content is 80-95% w/w, the hydrogen content is 1.6-3% w/w and the ash content is 2% w/w approx. The commonly used carbonaceous material is lamp black and/or furnace black.

According to one embodiment herein, the hydrocarbon is present in the raw material compound 1 in a range of 2-10% w/w. The hydrocarbon is selected from C5 to C36 compounds. The hydrocarbons have the following properties/characteristics. The ash content in hydrocarbon is less than 0.05% w/w in the hydrocarbon. The volatile matter content in hydrocarbon is more than 90% w/w in the hydrocarbon. The moisture content in hydrocarbon is less than 5% w/w.

According to one embodiment herein, the ultrafine metal or metal compound oxide nanoparticles are present in the raw material compound 1 in a range of 1-10% w/w. The ultrafine metal or metal compound oxide nanoparticles are selected from $CuFe_2O_4$, $CoFe_2O_4$, $ZnFe_2O_4$, $CuZnFe_2O_4$, $Fe_2O_3$, Gamma $Fe_2O_3$, $Fe_3O_4$, ZnO. The ultrafine metal or metal compound oxide nanoparticles have the following properties/characteristics. The particle size is less than 0.1 micron. The melting point of ultrafine metal or metal compound oxide nanoparticles is 1000° C. or more.

According to one embodiment herein, the ultrafine ceramic oxide nanoparticles are present in the raw material compound 1 in a range of 1-10% w/w. The ultrafine ceramic oxide nanoparticles have the following properties/characteristics. The particle size of the ultrafine ceramic oxide nanoparticles is less than 0.1 micron. The ultrafine ceramic oxide nanoparticles are selected from the following: alumina, beryllia, ceria, zirconia, silica/silica fume or fused silica.

According to one embodiment herein, the metallic wires are present in the raw material compound 1 at a concentration of 2% w/w. The metallic wires are made of iron, alloys of iron, steel or alloys of steel. The metallic wires act as a catalyst in raw material compound 1. The metallic wires create adsorption sites where carbon-metal-ceramic intermediate compounds are formed. The metallic wires have the following properties/characteristics. The metallic wires have a diameter up to 1.2 mm. The metallic wires have a length up to 3 mm.

According to one embodiment herein, the raw material compound 2 comprises carbon source, mainly natural carbon source. The natural carbon sources are saw dust, coffee husk, rice husk, tamarind seed husk and the other similar materials. The raw material compound 2 have the following properties/characteristics. The volatile matter is present in the raw material compound 2 is more than 70% w/w. The ash content is present in the raw material compound 2 is less than 3% w/w. The moisture content is present in the raw material compound 2 is less than 5% w/w. The particle size of the natural carbon source is in the range of −20 mesh to +100 mesh or Standard BSS Mesh.

According to one embodiment herein, the raw material compound 3 comprises carbon source, mainly synthetic or non-renewable sources. The carbon source, mainly synthetic or non-renewable sources are selected from coal dust, CPC, graphite, pitch powder and other similar materials. The raw material compound 3 have the following properties/characteristics. The ash content of the raw material compound 3 is less than 3% w/w. The volatile matter content of the raw material compound 3 is more than 10%. The moisture content of the raw material compound 3 is less than 5%.

According to one embodiment herein, the raw material compound 4 comprises of hydrocarbons. The hydrocarbons are selected from the hydrocarbon compounds from the group C5 to C36. The raw material compound 4 or the hydrocarbons have the following properties/characteristics. The ash content of the raw material compound 4 is less than 0.05% w/w. The volatile matter in the raw material compound 4 is more than 90% w/w. The moisture content in the raw material compound 4 is less than 5%.

According to one embodiment herein, the synthesizing of the raw material compound 1 comprises the following steps. The carbonaceous material, hydrocarbon, ultrafine metal/metal compound oxide nanoparticles in the range of 1-10% w/w, ultrafine ceramic oxide nanoparticles in the range of 1-10% w/w and metal wires in the range of less than 2% w/w are mixed. The carbonaceous material, hydrocarbon, ultrafine metal/metal compound oxide nanoparticles, ultrafine ceramic oxide nanoparticles and metal wires are mixed to obtain a mixture. The mixture is heated at a temperature of 200-500° C. with constant agitation for 1 hour. The temperature is maintained for 8-24 hours with constant agitation. The reaction is stopped after 8-24 hours by stopping the heat. The air at ambient temperature is allowed to pass through the reactor and the mixture is allowed to cool to a room temperature or at least a temperature of 50° C. The agitation is continued until the mixture is cooled to the room temperature or at least a temperature of 50° C. The raw material compound 1 is obtained after the cooling of mixture is packaged into bags.

According to one embodiment herein, a pressure controlled batch reactor is used for the synthesis of raw material compound 1. The reactor comprises a feeding system, a heating jacket, a cooling jacket, an indirect heating system and a bagging system. The pressure controlled batch reactor has a heating jacket and 15 mm thick stainless steel wall which works at 0.3-45 atmospheric pressure.

According to one embodiment herein, the raw material compound 1 has the following properties. The graphene content in the raw material compound 1 is less than 1% w/w. The carbon component has the structure similar to graphite with covalent bonds. The carbon component is impregnated with nano-ceramic oxides and nano metal oxides. The volatile matter in the raw material compound 1 is present at a concentration of less than 15% w/w. The ash content in the raw material compound 1 is 30% w/w, specifically in the range of 9-16% w/w. The raw material compound 1 does not soften. The raw material compound 1 exhibits a maximum free-flow characteristic at a temperature of 925° C. The mesh size percentage retained by the raw material compound 1 is illustrated in the Table 1 below:

| Sl. No. | Mesh Size(BSS) | Percentage (%) |
|---|---|---|
| 1. | 10 | — |
| 2. | 16 | 3 |
| 3. | 30 | 9 |
| 4. | 35 | 5 |
| 5. | 40 | 7 |
| 6. | 60 | 23 |
| 7. | 100 | 18 |
| 8. | 140 | 16 |
| 9. | 200 | 8 |
| 10. | 270 | 5 |
| 11. | 325 | 3 |

According to one embodiment herein, the raw material compound 1 has the following chemical composition at molecular level. The chemical composition at molecular level of the raw material compound 1 is illustrated in the Table 2 below:

| Sl. No. | Molecules | Percentage (%) |
|---|---|---|
| 1. | Carbon | 80-88% |
| 2. | Hydrogen | 1.5-2% |
| 3. | Nitrogen | 0.3-0.4% |
| 4. | Oxygen | Less than 3% |
| 5. | Silica | Less than 3% |
| 6. | Zinc | 3-4% |
| 7. | Iron | 3-5% |
| 8. | Titanium, Aluminum, Sodium, Potassium, Magnesium, Copper | Less than 2% |

The time, temperature and pressure are varied with respect to a change in the volatile matter (VM) and fixed Carbon in the end product. For example, the reaction is carried out for 8 hours at 250° C. under 1 atmospheric pressure to reduce the formation of graphene and the VM in the final product. The graphene and the volatile matter in the final product or raw material compound 1 is more than 20%. On the other hand, the reaction process is carried out for 18 hours at 45 bar and 450° C. to create graphene of 1-2%, and volatile matter (VM) of the final product is less than 5%.

According to one embodiment herein, the synthesis of the composition comprising nanoparticles impregnated into carbon comprises the following steps. The raw material compound 2 and the raw material compound 4 are mixed in a mixer. The mixer is selected from a ribbon mixer or tumble mixer or other kind of mixers suitable for mixing. The raw material compound 2 and raw material compound 4 are mixed for 10 minutes until the raw material compound 4 is uniformly coated over raw material compound 2. After 10 minutes of mixing, an intermediate product is obtained. The intermediate product comprises volatile matter at a concentration of 80-85% w/w, more particularly 82-84% w/w. The intermediate product has an ash content in a range of 2-4% w/w, more particularly in a range of 3-4% w/w.

Table 3 below illustrates the quantity of the raw material compound 2 and raw material compound 4 used for the synthesis of intermediate product:

| Composition | Wide range by weight | Specific range by weight |
|---|---|---|
| Raw material compound 2 | 90-98% | 95-97.5% |
| Raw material compound 4 | 2-10% | 2.5-5% |

Then the raw material compound (RM) 1 and raw material compound 3 are mixed to the intermediate product in a mixer. The mixer is selected from a ribbon mixer or tumble mixer or other kind of mixers suitable for mixing. The raw material compound 1, the raw material compound 3 and intermediate product are mixed for 10 minutes until a uniform/homogeneous mixture is obtained. The mixture comprises nanoparticles impregnated into carbon. The mixture comprising nanoparticles impregnated into carbon is the final product. High density polyethylene (HDPE) bags are used for easy use and handling of the final product.

Table 4 below illustrates the quantity of the raw material compound 1, raw material compound 3 and intermediate product present in the final product nanoparticles impregnated into carbon:

| Final Product (FP) | wide range by weight |
|---|---|
| IFP1 | 30-75% |
| RM1 | 20-70% |
| RM3 | 20-70% |

The equipments utilized for the synthesis of the mixture comprises of nanoparticles impregnated into carbon are feeding system, blending/mixing machine such as ribbon mixer, tumble mixer and bagging system.

The exact amount of the components for synthesizing the composition comprising nanoparticles impregnated into carbon is selected based on the desired amount/quantity of volatile matter (VM) in the final product. When a final product with higher VM is expected, then the quantity of intermediate product is more than 60% w/w and the quantity of raw material compound 1 and raw material compound 2 is 40% w/w. When a product with lower VM is expected, then the quantity of intermediate product is in a range of 30-40% w/w and the quantity of raw material compound 1 and raw material compound 3 is in a range of 60-70% w/w. The final product is made in different grades based on the quantity of the intermediate product, raw material compound 1 and raw material compound 3. The final product is made in different grades namely Cerakarb™40, Cerakarb™20 and Cerakarb™60.

Table 5 below illustrates the composition of Cerakarb™40:

| Cerakarb ™ 40 | | | | |
|---|---|---|---|---|
| | Weight in Kgs | Percentage | VM | Ash |
| IFP1 | 150 | 57.69 | 82.69 | 2.88 |
| RM-1 | 100 | 38.46 | 7 | 14 |
| RM-3 | 0 | 3.85 | 11 | 1 |
| Total | 260 | | | |
| | | | 50.82 | 7.09 |
| | | Fixed Carbon | 42.09 | |

Table 6 below illustrates the composition of Cerakarb™20:

| Cerakarb ™ 20 | | | | |
|---|---|---|---|---|
| | Weight in Kgs | Percentage | VM | Ash |
| IFP1 | 200 | 66.67 | 82.69 | 2.88 |
| RM-1 | 50 | 16.67 | 7 | 14 |
| RM-3 (High VM Pitch) | 50 | 16.67 | 60 | 1 |
| Total | 300 | | | |
| | | | 66.29 | 4.42 |
| | | Fixed Carbon | 29.28 | |

Table 7 below illustrates the composition of Cerakarb™60:

| CerakarbTM 60 | | | | |
|---|---|---|---|---|
| | Weight in Kgs | Percentage | VM | Ash |
| IFP1 | 105 | 39.62 | 82.69 | 2.88 |
| RM-1 | 150 | 56.60 | 7 | 14 |
| RM-3 | 10 | 3.77 | 11 | 1 |
| Total | 265 | | | |
| | | | 37.14 | 9.11 |
| | | Fixed Carbon | 53.75 | |

FIG. 1 illustrates a process flow diagram indicating the steps of processes followed in a sand casting method in a foundry, according to an embodiment herein. With respect to FIG. 1, the sand additions required for the sand casting are new sand, lustrous carbon additive, bentonite and water (101*a*). The sand additions 101*a* are pre-processed to obtain a sand mould. The preprocessing is done by homogenization or hydration or mixing. After the preprocessing, the mixture is obtained. The mixture is subjected to molding 102 with core of sand to form a pattern/sand mould. The molding 102 of mixture or sand additions 101*a* is done by horizontal method or by vertical method. After molding 102 the pattern/sand mold is subjected to pouring 103. During the pouring 103 following losses occur. The sand temperature increases leading to the burn-out of clay and lustrous carbon additive to increase the gas emissions which cause health hazards. Then the pattern/sanding is subjected to shake out 104. The shakeout 104 is done by drum method or vibratory method. In the shakeout 104 process, there is sand loss. The sand adhering to the sand castings is extracted by shaking. After shake out 104, the sand obtained is subjected to magnetic separator 105. After subjecting the sand to magnetic separator 105, the sand is screened 106. The screened sand is subjected to dust extractor 108, for removing the dust. The sand is again subjected to cooling 107. After cooling the sand, the sand is again subjected to dust extractor 108 to remove the dust gain. After cooling the sand, the sand is again used in the preparation 101, of sand mould.

Figure 2:
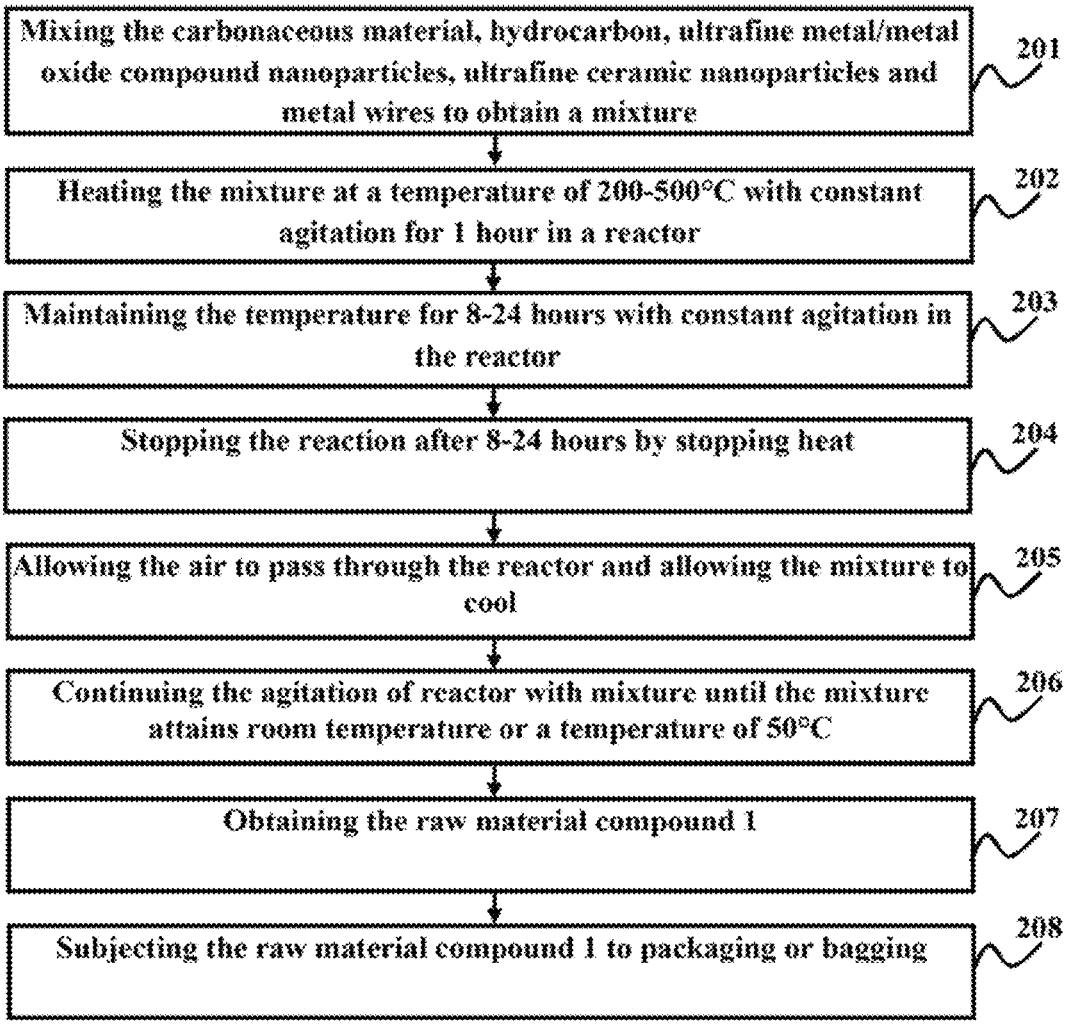
FIG. 2 illustrates a flow chart indicating a method of synthesizing raw material compound 1 for synthesizing a nanoparticle based sand conditioner composition for foundry, according to an embodiment herein.

FIG. 2 illustrates a flow chart indicating a method of synthesizing raw material compound 1 for synthesizing a nanoparticle based sand conditioner composition for foundry, according to an embodiment herein. With respect to FIG. 2, the carbonaceous material, hydrocarbon, ultrafine metal/metal oxide compound nanoparticles, ultrafine ceramic oxide nanoparticles and metal wires are mixed to obtain a mixture (201). The mixture is heated at a temperature of 200-500° C. with constant agitation for 1 hour in a reactor (202). The temperature is maintained for 8-24 hours with constant agitation in the reactor (203). The pressure may vary from 0.3 atm to 45 atm. The reaction is stopped after 8-24 hours by stopping the heat supply (204). The air at ambient temperature is allowed to pass through the reactor and the mixture is allowed to cool (205). The agitation of reactor with mixture is continued until the mixture attains room temperature or a temperature of 50° C. (206). The raw material compound 1 is obtained (207). The raw material compound 1 is subjected to packaging or bagging (208).

Figure 3:
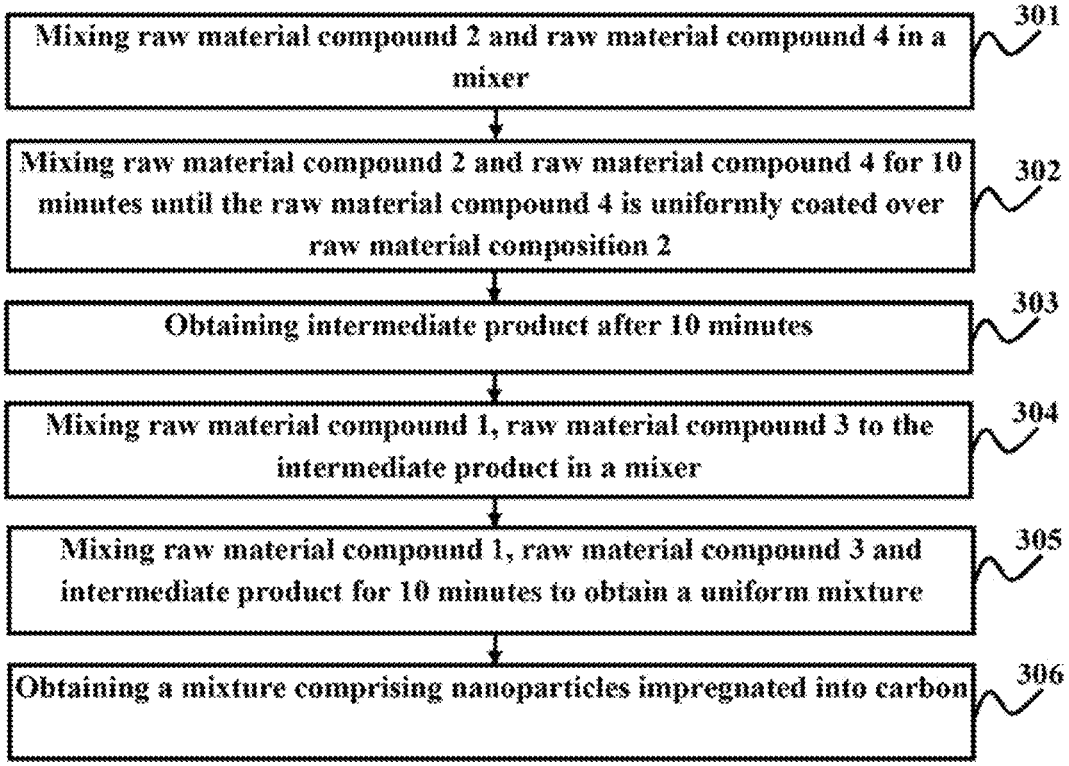
FIG. 3 illustrates a flow chart indicating a method of synthesizing a nanoparticle based sand conditioner composition for foundry, according to an embodiment herein.

FIG. 3 illustrates a flow chart indicating a method of synthesizing a nanoparticle based sand conditioner composition for foundry, according to an embodiment herein. With respect to FIG. 3, the raw material compound 2 and raw material compound 4 are mixed in a mixer (301). The raw material compound 2 comprises carbon source mainly natural carbon source. The natural carbon sources are saw dust, coffee husk, rice/paddy husk, tamarind seed husk and other similar materials. The raw material compound 4 comprises of hydrocarbons selected from a group of C5 to C36. The raw material compound 2 and raw material compound 4 are mixed for 10 minutes until the raw material compound 4 is uniformly coated over raw material compound 2 (302). The intermediate product is obtained after 10 minutes (303). The raw material compound 1, and the raw material compound 3 are mixed to the intermediate product in a mixer (304). The raw material compound 1, raw material compound 3 and intermediate product are mixed for 10 minutes to obtain a uniform mixture (305). The raw material compound 1 comprises carbonaceous material, hydrocarbon, ultrafine metal/metal oxide compound nanoparticles, ultrafine ceramic oxide nanoparticles and metal wires. The raw material compound 3 comprises carbon source mainly synthetic or non-renewable sources. The mixture comprising nanoparticles impregnated into carbon is obtained (306). The mixture comprising nanoparticles impregnated into carbon is referred to as Cerakarb™. Laminated high density polyethylene (HDPE) bags are used for easy use and handling of Cerakarb™.

According to one embodiment herein, the nano-ceramic particles are added to form a barrier between the sand and the molten metal. At extreme temperatures the nanoparticles form a non-wetting barrier between the molten metal and the sand. The nanoparticles increase the hot strength or wet tensile strength (WTS) of sand. The nanoparticles make the sand more resistant to expansion defects like scabbing, rat tail etc.

Figure 4:
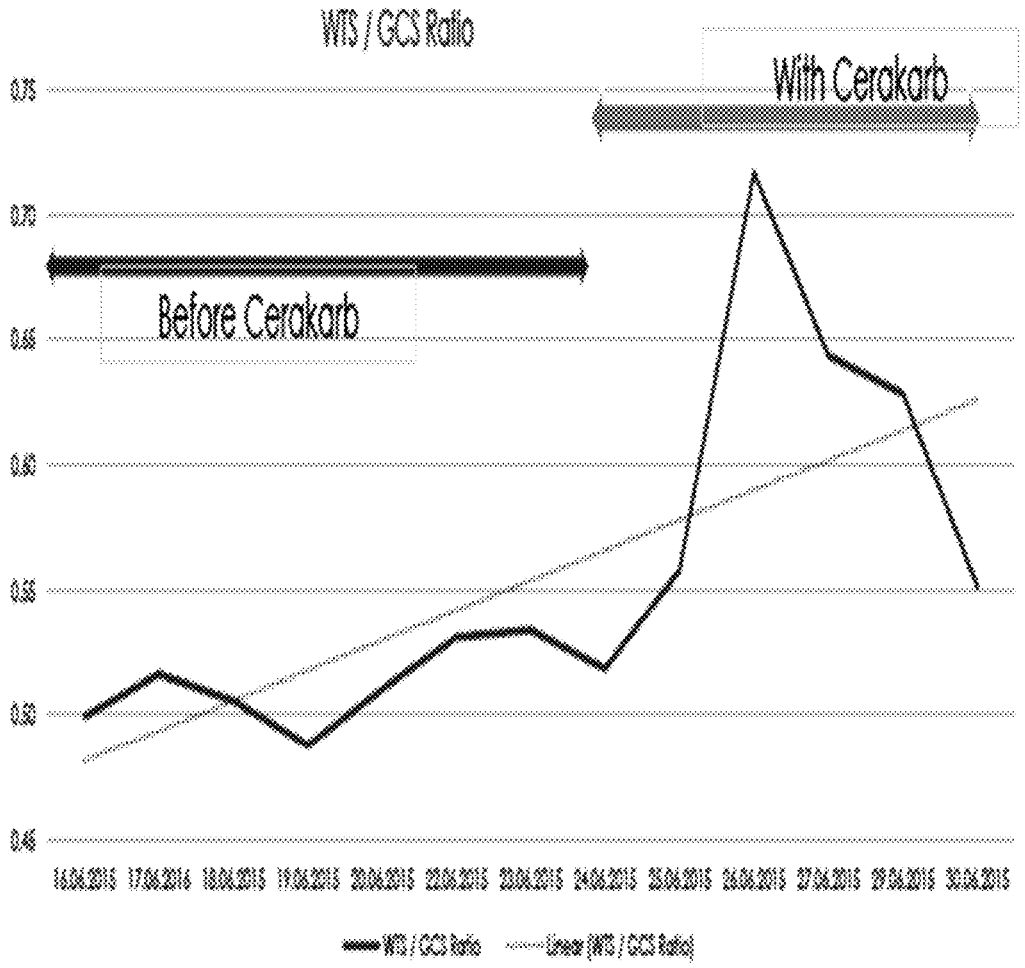
FIG. 4 illustrates a graph illustrating the effect of Wet Tensile Strength/Green Compressive Strength (WTS/GCS) ratio of a nanoparticle based sand conditioner composition for foundry (Cerakarb™), according to an embodiment herein.

FIG. 4 illustrates a graph illustrating the effect of Wet Tensile Strength/Green Compressive Strength (WTS/GCS) ratio of a nanoparticle based sand conditioner composition for foundry (Cerakarb™), according to an embodiment herein. The FIG. 4 illustrates the effect of Cerakarb™ with nanoparticles impregnated into carbon on the Wet Tensile Strength/Green Compressive Strength (WTS/GCS) ratio, according to an embodiment herein. The WTS/GCS ratio of the sand mould is increased significantly after Cerakarb™ is used in the foundries. The graph illustrates lower WTS/GCS ratio before using the Cerakarb™, and higher WTS/GCS ratio after using the Cerakarb™.

Figure 5:
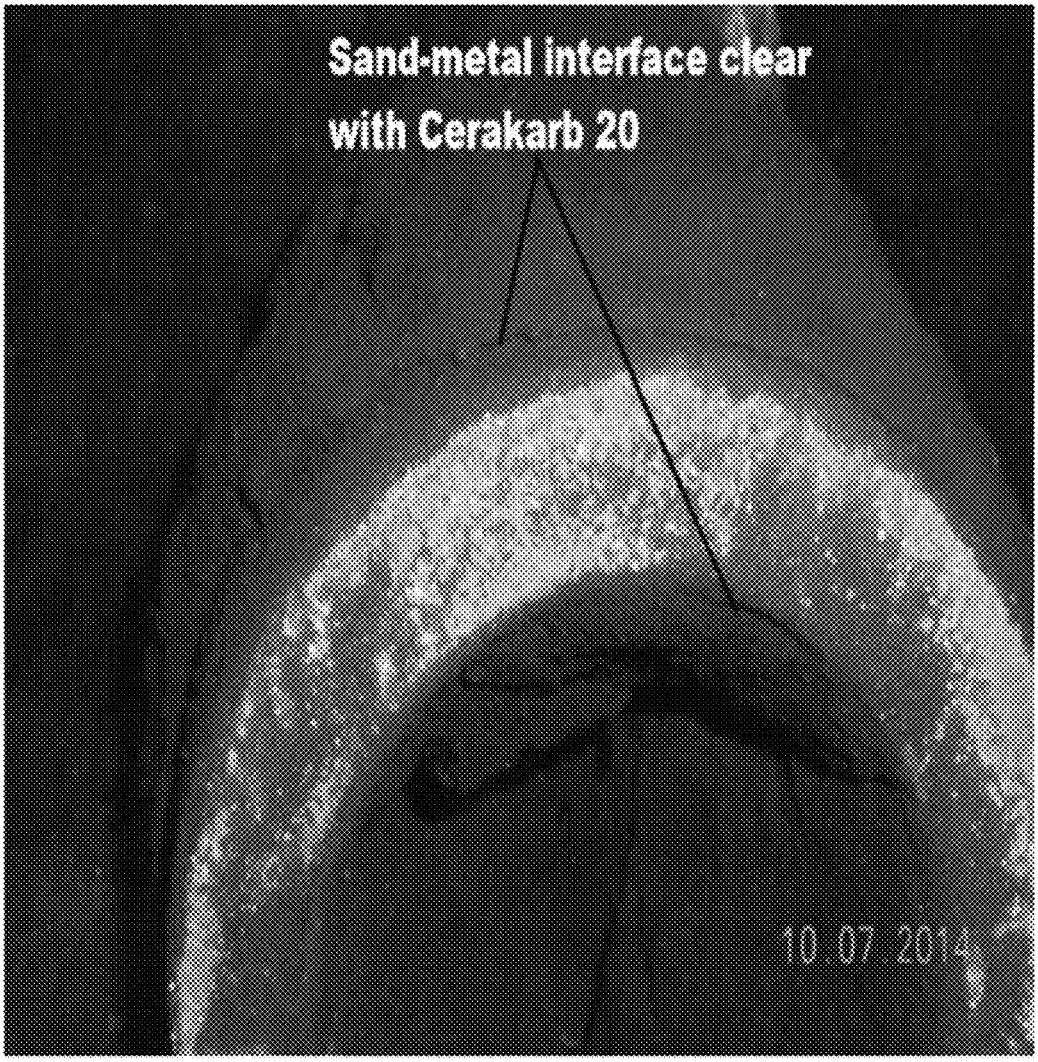
FIG. 5 illustrates a photograph indicating the sand metal interface of a cast product after using the nanoparticle based sand conditioner composition for foundry (Cerakarb™-20), according to an embodiment herein.

FIG. 5 illustrates a photograph indicating the sand metal interface of a cast product after using the nanoparticle based sand conditioner composition for foundry (Cerakarb™-20), according to an embodiment herein. With respect to FIG. 5 indicates the sand metal interface after using the Cerakarb™, according to an embodiment herein. The photograph illustrates the clear sand-metal interface after Cerakarb™ is used in the sand foundry for casting metals.

According to one embodiment herein, Table 8 below illustrates the information about the foundry 1:

| PARAMETER | DETAILS | |
|---|---|---|
| 1. Capacity of the Foundry per month Capacity(MT): | 3000 | |
| 2. Type of Alloy (SG or CI) | 75% SG + 25% CI | |
| 3. Furnace (Nos. & Capacity) | 1T Tri track furnace | |
| 4. Moulding Lines Details | Make | Type |
| Line 1 | ARPA | 450 |
| Line 2 | ARPA | 650 |
| Line 3 | DISAFLEX | High Pressure Line |

The foundry 1 utilizes the Cerakarb™ for casting the metals. After using the Cerakarb™ for casting metals the sand peels off easily from the castings during shake out. There is 30% reduction in sand sticking on the metal surface, after using Cerakarb™. Also the surface finish and the shine on the casting surface of metal is increased after using Cerakarb™.

Table 9 below illustrates the advantages of using Ceracarb™ in foundry 1:

| Sl No. | Parameter | Before | After | % Change |
|---|---|---|---|---|
| 1. | Lustrous Carbon Consumption | 4.5 Kg/batch | 4.0 Kg/batch | −11.11% |
| 2. | Bentonite consumption in ARPA Line | 14.0 Kg/batch | 12.0 Kg/batch | −14.28% |
| 3. | Bentonite Consumption in High Pressure Moulding (DISA) Line | 16.0 Kg/batch | 14.0 Kg/batch | −13.33% |

Figure 6:
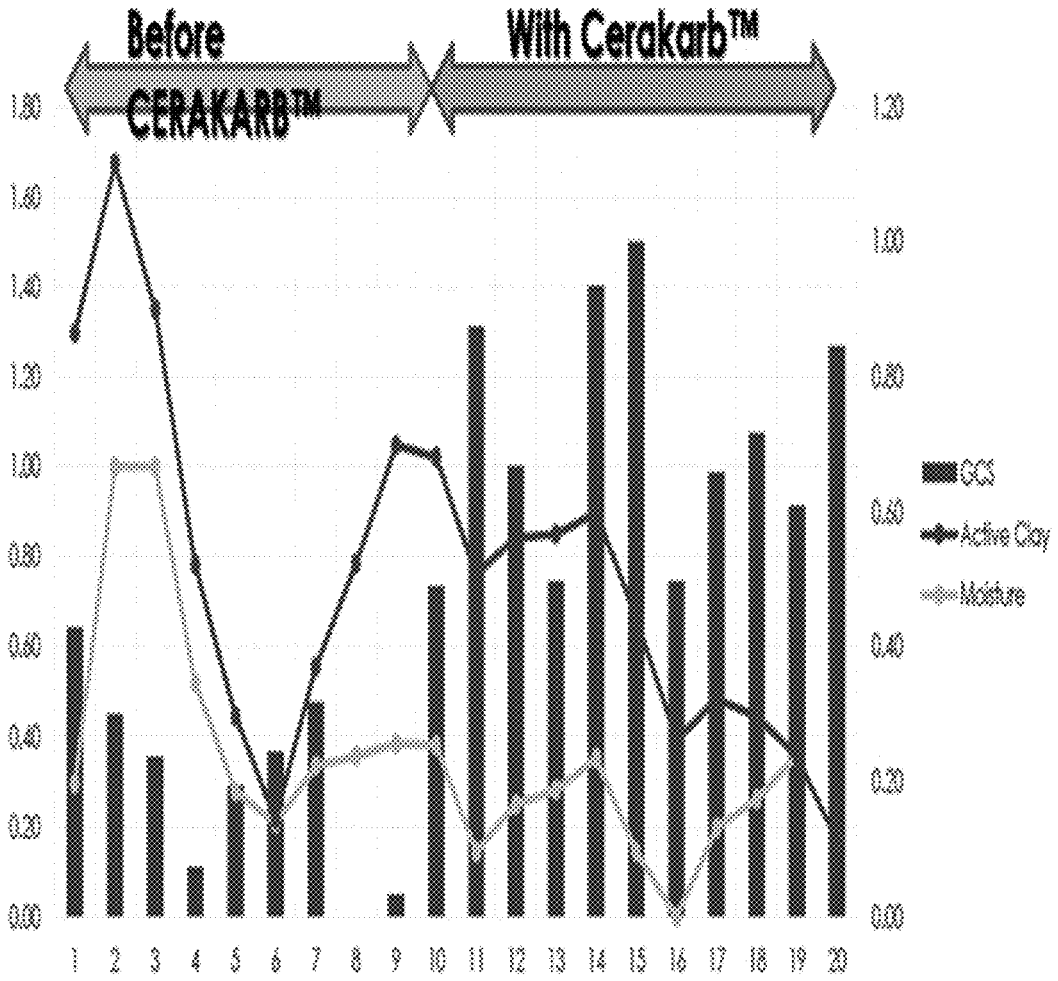
FIG. 6 illustrates a graph indicating a content of GCS, active clay and moisture in a sand conditioner composition before and after use of carbon impregnated nanoparticle based sand conditioner composition (Cerakarb™) in foundry, according to an embodiment herein.

FIG. 6 illustrates a graph indicating a content of GCS, wet clay and moisture in a sand conditioner composition before and after use of carbon impregnated nanoparticle based sand conditioner composition (Cerakarb™) in foundry, according to an embodiment herein. FIG. 6 illustrates the effect of using Cerakarb™ in foundry, according to an embodiment herein. The graph illustrates that the consumption of active clay was higher before using Cerakarb™. The graph also illustrates that the moisture content in the sand mould was high before using Cerakarb™. The graph further illustrates that the consumption of active clay decreased, and the moisture content in the sand mould also decreased after using the Cerakarb™.

According to one embodiment herein, Table 10 below illustrates the information about the foundry 2:

| COMPONENT | DETAILS | |
|---|---|---|
| 1. Capacity of the Foundry per month | | |
| Capacity(MT): | 6500 | |
| Current Production(MT): | 4800 | |
| 2. Type of Alloy (SG or CL) | 100% SG | |
| 3. Furnace (Nos. & Capacity) | | |
| 4 Moulding Lines Details | Make | Type |
| Line 1 | 450 × 2 | ARPA |
| Line 2 | 900 | ARPA |
| Line 3 | 1300 | ARPA |

The foundry 2 utilizes the Cerakarb™ for casting the metals. After using the Cerakarb™ for casting metals the sand peels off easily from the castings during shake out. There is reduction in sand sticking on the metal surface, after using Cerakarb™. Also the surface finish and the shine on the casting surface of metal are increased after using Cerakarb™.

Table 10 below illustrates the advantages of using Cerakarb™ in foundry 2:

| Sl. No. | Parameter | Before | After | % Change |
|---|---|---|---|---|
| 1. | Bentonite Consumption in ARPA Line | 10.7 Kg/batch | 8.7 Kg/batch | −18.69% |
| 2. | WTS Increase in Sand | 9.5 psi | 10.75 psi | +13.15% |
| 3. | Cerakarb ™ Consumption in ARPA Line | 3.3 Kg/batch | 2.8 Kg/batch | −15.15% |

Wet tensile strength (WTS) is the measure of resistance to expansion defects like scabbing, rat tail etc. Higher WTS is always preferred in foundries.

Figure 7:
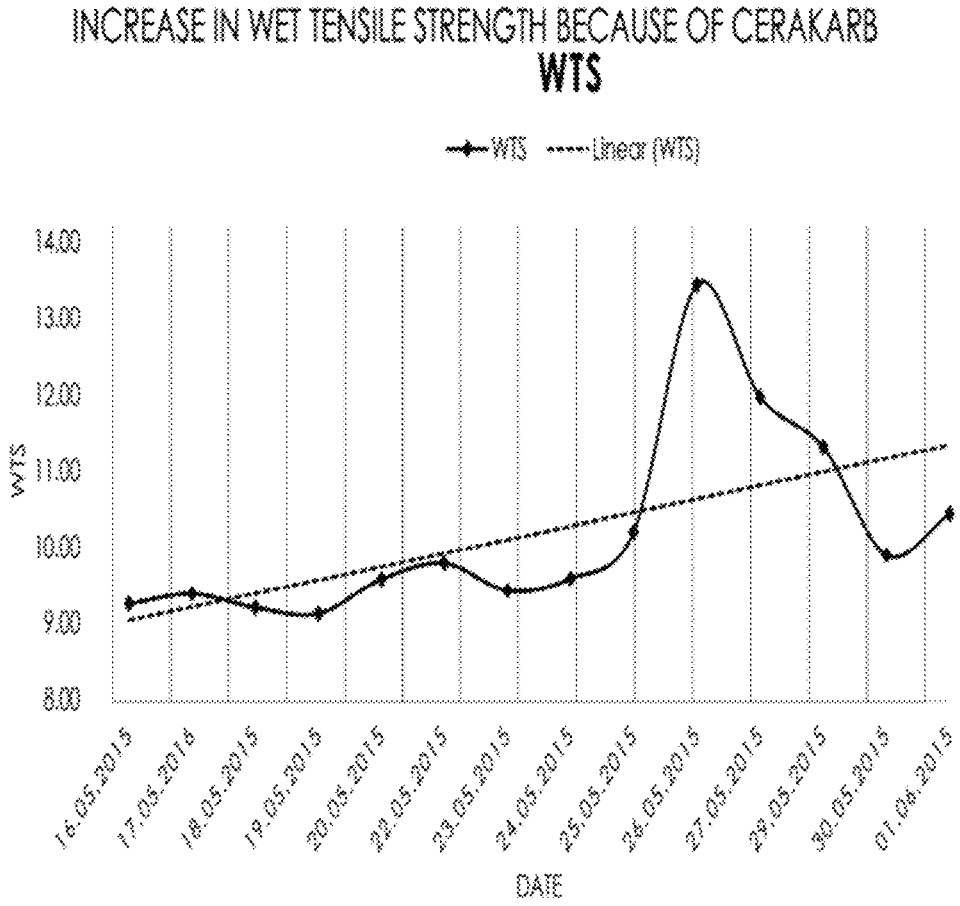
FIG. 7 illustrates a graph indicating an effect of wet tensile strength (WTS) of carbon impregnated nanoparticle based sand conditioner composition (Cerakarb™) in foundry with respect to time, according to an embodiment herein.

FIG. 7 illustrates a graph indicating an effect of wet tensile strength (WTS) of carbon impregnated nanoparticle based sand conditioner composition (Cerakarb™) in foundry with respect to time, according to an embodiment herein. FIG. 7 illustrate the effect of Cerakarb™ on the wet tensile strength of sand casting foundry. The graph illustrates the increase in the WTS of the sand mould after using the Cerakarb™ in the foundry industry.

Figure 8:
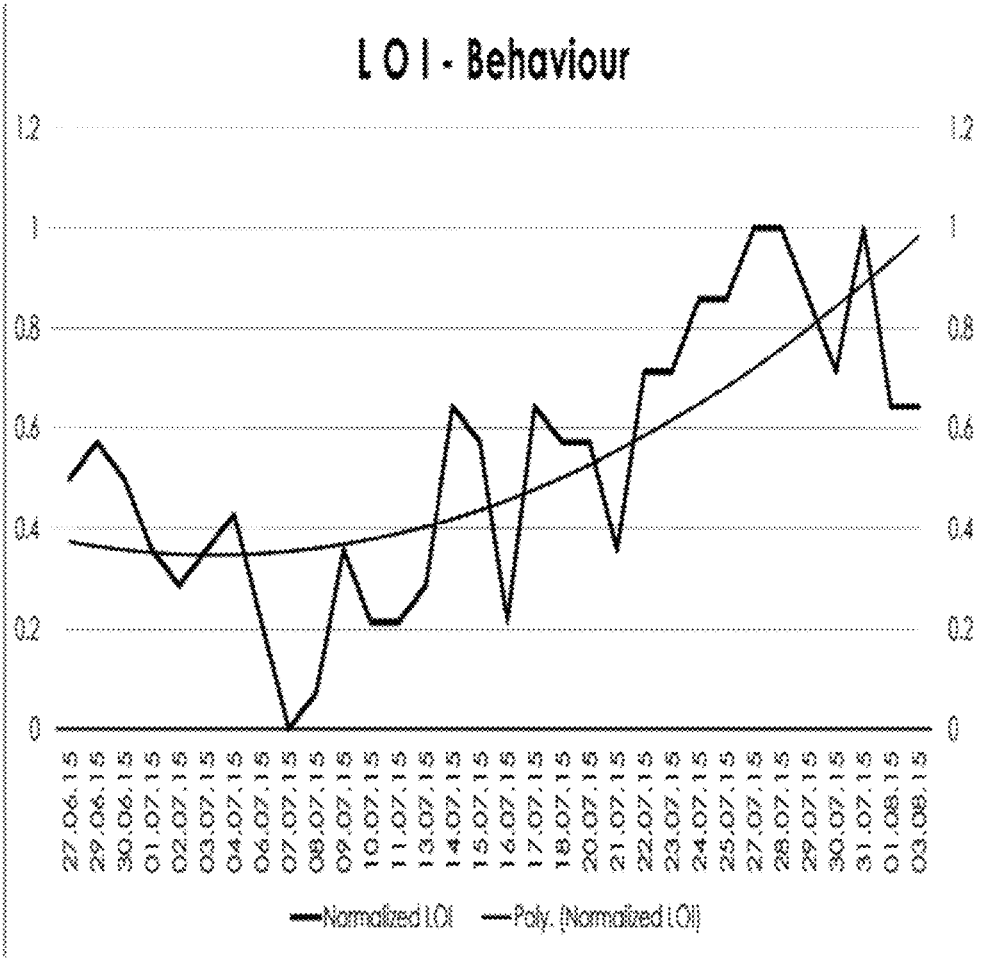
FIG. 8 illustrates a graph indicating a Loss of Ignition (LOI) behavior of carbon impregnated nanoparticle based sand conditioner composition (Cerakarb™) in foundry with respect to time, according to an embodiment herein.

FIG. 8 illustrates a graph indicating a Loss of Ignition (LOI) behavior of carbon impregnated nanoparticle based sand conditioner composition (Cerakarb™) in foundry with respect to time, according to an embodiment herein. FIG. 8 illustrates the effect of Cerakarb™ on the Loss of Ignition (LOI) behavior of sand casting foundry industry, according to an embodiment herein. The graph illustrates that the LOI behavior of the sand mould increases after the use of Cerakarb™.

Figure 9:
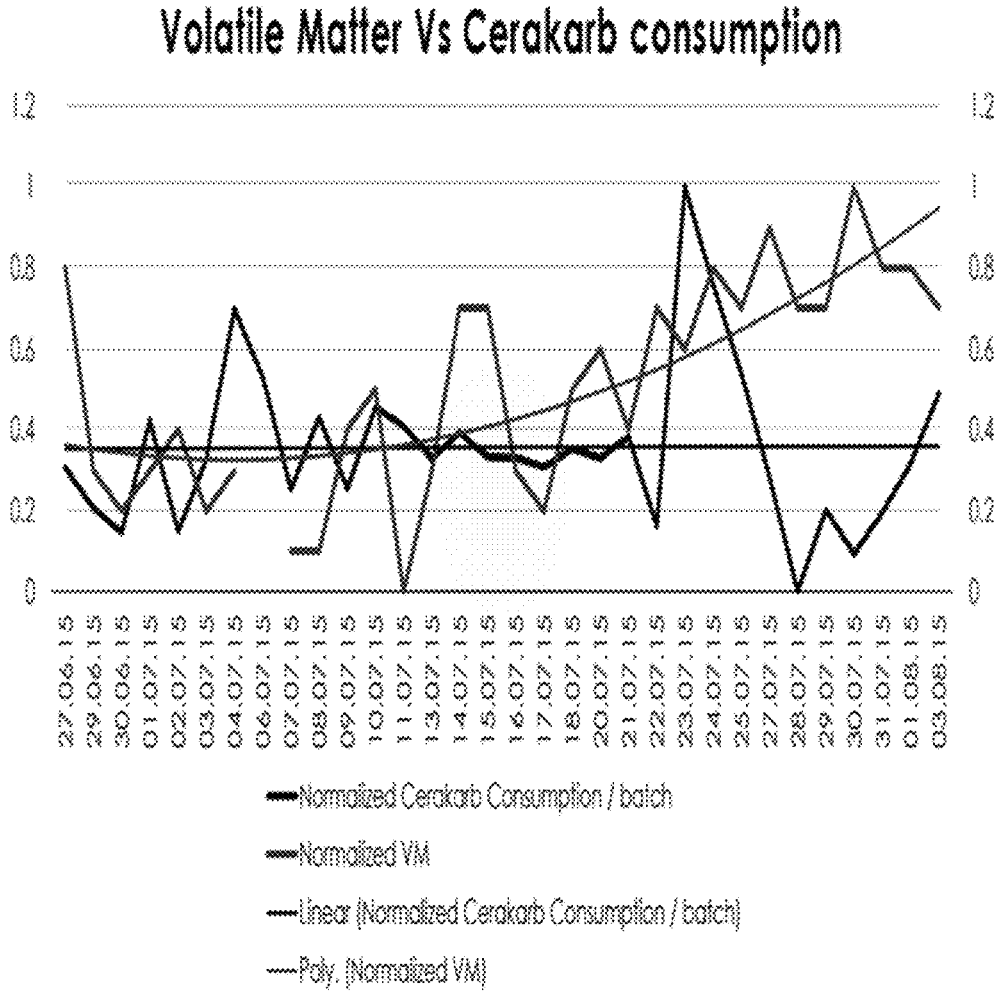
FIG. 9 illustrates a graph indicating a relationship between a content of volatile matter and a consumption of carbon impregnated nanoparticle based sand conditioner composition (Cerakarb™) in foundry with respect to time, according to an embodiment herein.

FIG. 9 illustrates a graph indicating a relationship between a content of volatile matter and a consumption of carbon impregnated nanoparticle based sand conditioner composition (Cerakarb™) in foundry with respect to time, according to an embodiment herein. FIG. 9 illustrates the comparison of the concentration of volatile matter and the consumption of Cerakarb™ in sand casting foundry industry, according to an embodiment herein. The graph illustrates that as the volatile matter increases in the sand, the consumption of Cerakarb™ decreases.

Figure 10:
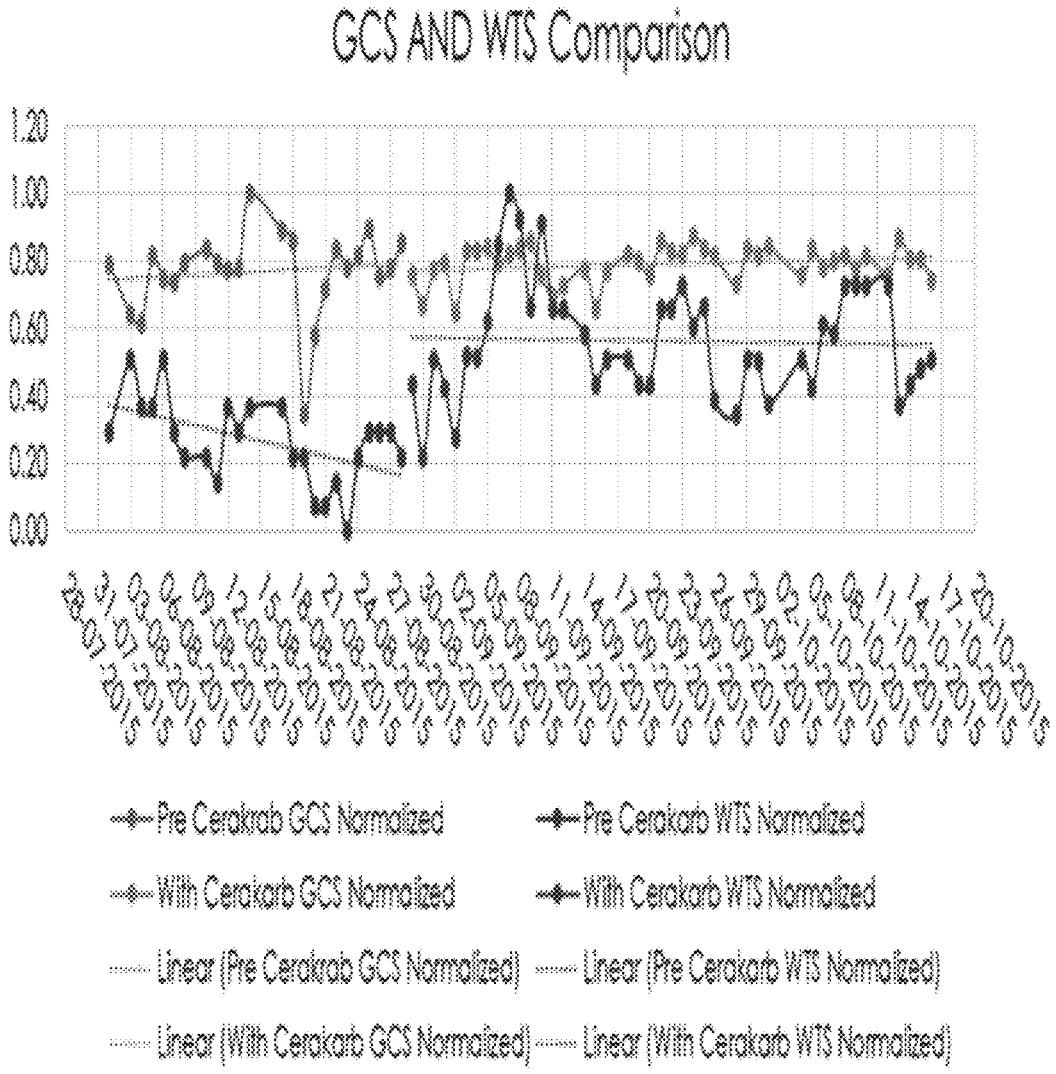
FIG. 10 illustrates a graph indicating the comparison of Green Compressive Strength (GCS) and the wet tensile strength (WTS) before and after a use of carbon impregnated nanoparticle based sand conditioner composition (Cerakarb™) in foundry with respect to time, according to an embodiment herein.

FIG. 10 illustrates a graph indicating the comparison of Green Compressive Strength (GCS) and the wet tensile strength (WTS) before and after a use of carbon impregnated nanoparticle based sand conditioner composition (Cerakarb™) in foundry with respect to time, according to an embodiment herein. FIG. 10 illustrates the comparison between Green Compressive Strength (GCS) and the wet tensile strength (WTS) after using Cerakarb™ in the sand mould, according to an embodiment herein. The graph illustrates that once Cerakarb™ is introduced into the sand mould system, there is an increase in the WTS. The Cerakarb™ has no effect on the GCS, but the WTS increases in the presence of Cerakarb™.

Figure 11:
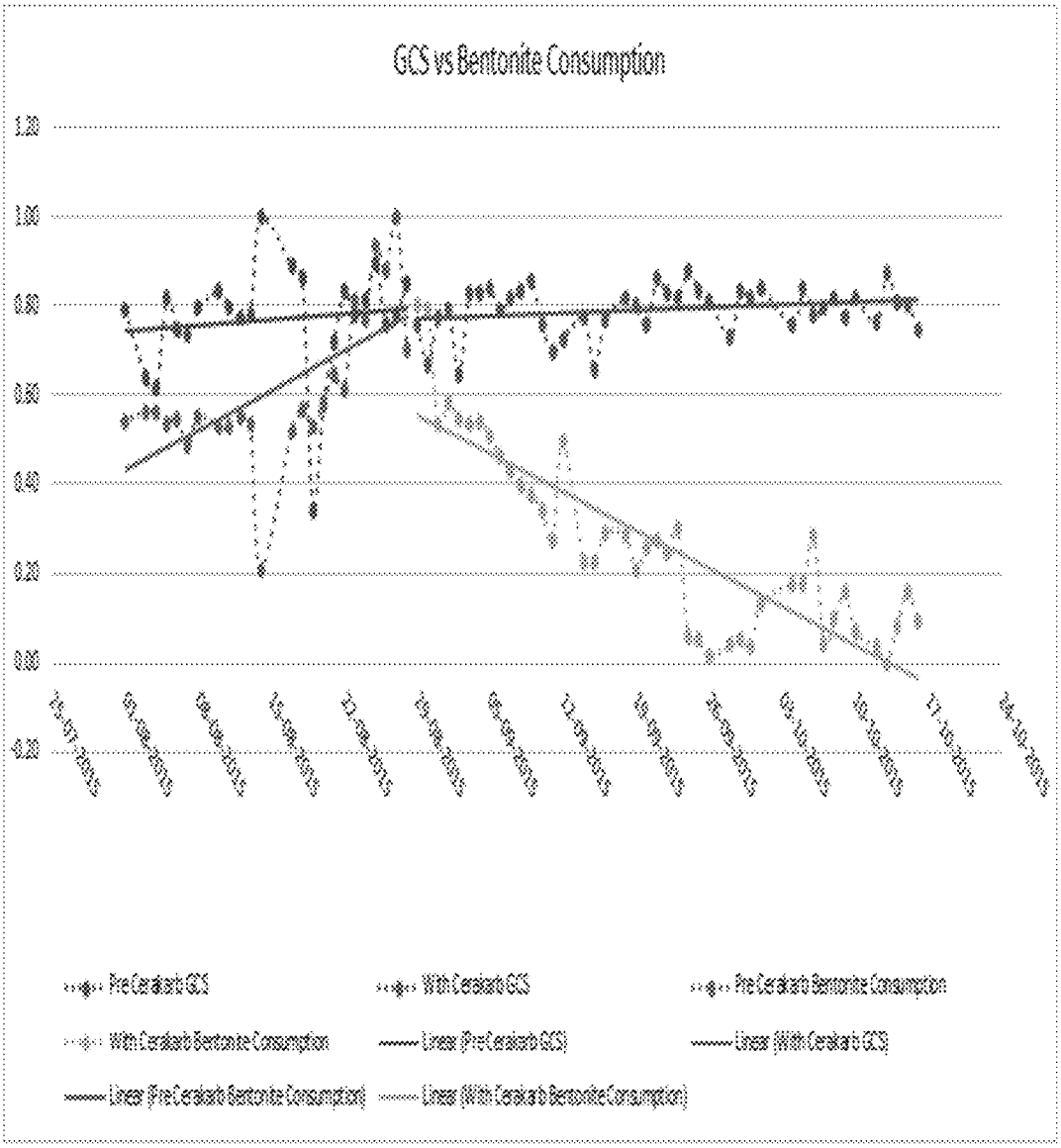
FIG. 11 illustrates a graph indicating a comparison of the Green Compressive Strength (GCS) and the consumption of bentonite before and after a use of carbon impregnated nanoparticle based sand conditioner composition (Cerakarb™) in foundry with respect to time, according to an embodiment herein.

FIG. 11 illustrates a graph indicating a comparison of the Green Compressive Strength (GCS) and the consumption of bentonite before and after a use of carbon impregnated nanoparticle based sand conditioner composition (Cerakarb™) in foundry with respect to time, according to an embodiment herein. FIG. 11 illustrates the Green Compressive Strength (GCS) and the consumption of bentonite after using Cerakarb™ in the sand mould, according to an embodiment herein. The Cerakarb™ is responsible for reduced bentonite consumption. The GCS remains consistent, but there is a drastic drop in the consumption of bentonite with increase in the Cerakarb™.

Figure 12:
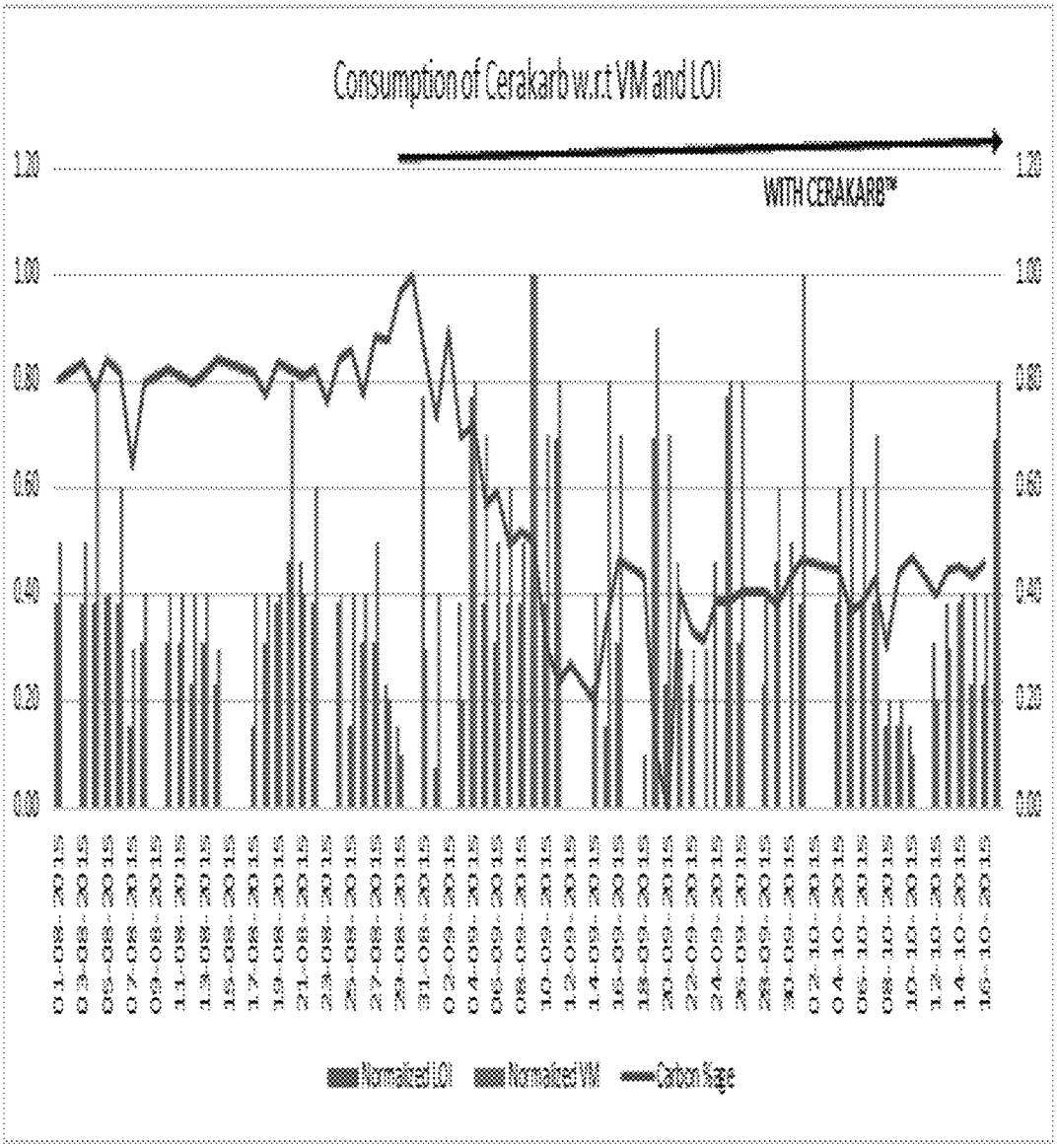
FIG. 12 illustrates a graph indicating a comparison of volatile matter and loss of ignition before and after a use of carbon impregnated nanoparticle based sand conditioner composition (Cerakarb™) in foundry with respect to time, according to an embodiment herein.

FIG. 12 illustrates a graph indicating a comparison of volatile matter and loss of ignition before and after a use of carbon impregnated nanoparticle based sand conditioner composition (Cerakarb™) in foundry with respect to time, according to an embodiment herein. FIG. 12 illustrates the impact of Cerakarb™ on the volatile matter and loss of ignition (LOI) in the sand mould, according to an embodiment herein. The Volatile Matter (VM) and Loss on Ignition (LOI) is consistent throughout the time period. The graph further illustrates that when Cerakarb™ is used for the synthesis of sand mould the quantity required to maintain the VM and LOI has drastically reduced.

Figure 13A:
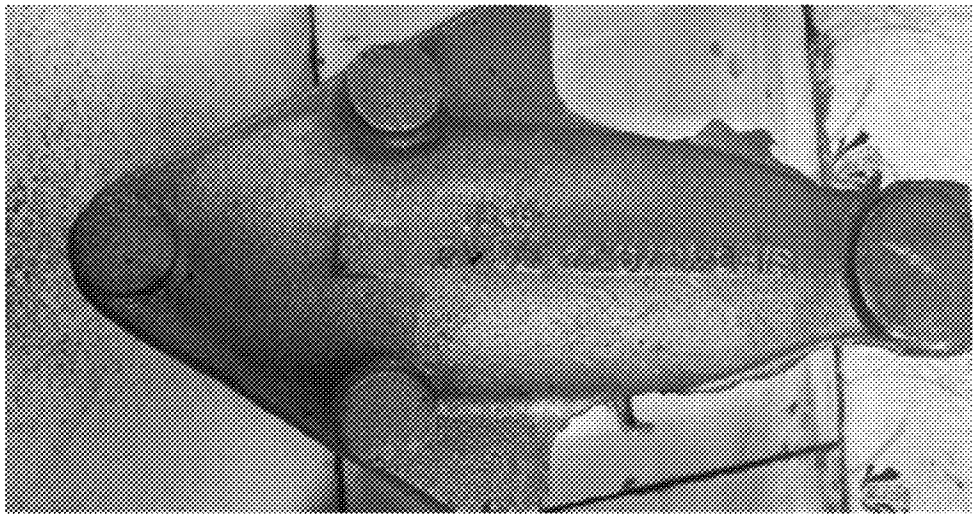
FIG. 13A illustrates a photograph indicating a surface finish of cast product before a use of carbon impregnated nanoparticle based sand conditioner composition (Cerakarb™) in foundry, according to an embodiment herein.
Figure 13B:
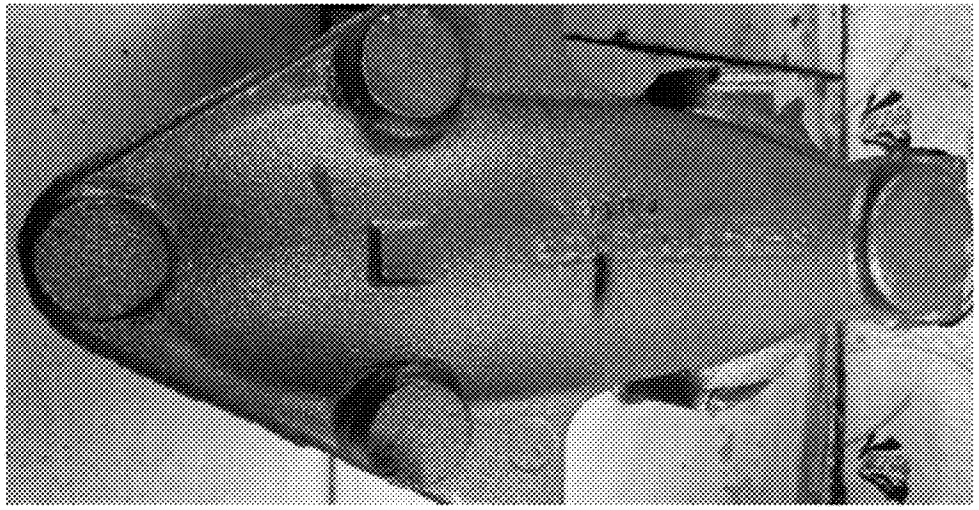
FIG. 13B illustrates a photograph indicating a surface finish of cast product after a use of carbon impregnated nanoparticle based sand conditioner composition (Cerakarb™) in foundry, according to an embodiment herein.

FIG. 13A illustrates a photograph indicating a surface finish of cast product before a use of carbon impregnated nanoparticle based sand conditioner composition (Cerakarb™) in foundry, according to an embodiment herein. FIG. 13B illustrates a photograph indicating a surface finish of cast product after a use of carbon impregnated nanoparticle based sand conditioner composition (Cerakarb™) in foundry, according to an embodiment herein. FIG. 13A illustrates the dull and unclean surface finish of the metal product made without Cerakarb™ sand mould, whereas FIG. 13B illustrates the bright, smooth and clean surface finish of the metal product made in Cerakarb™ sand mould.

Figure 14A:
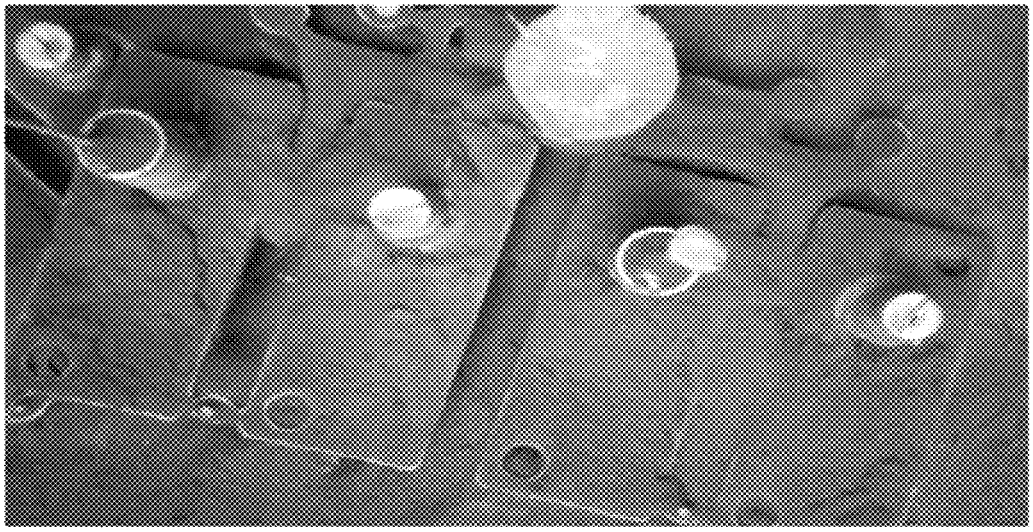
FIG. 14A illustrates a photograph indicating a sand peel property of cast product before a use of carbon impregnated nanoparticle based sand conditioner composition (Cerakarb™) in foundry, according to an embodiment herein.
Figure 14B:
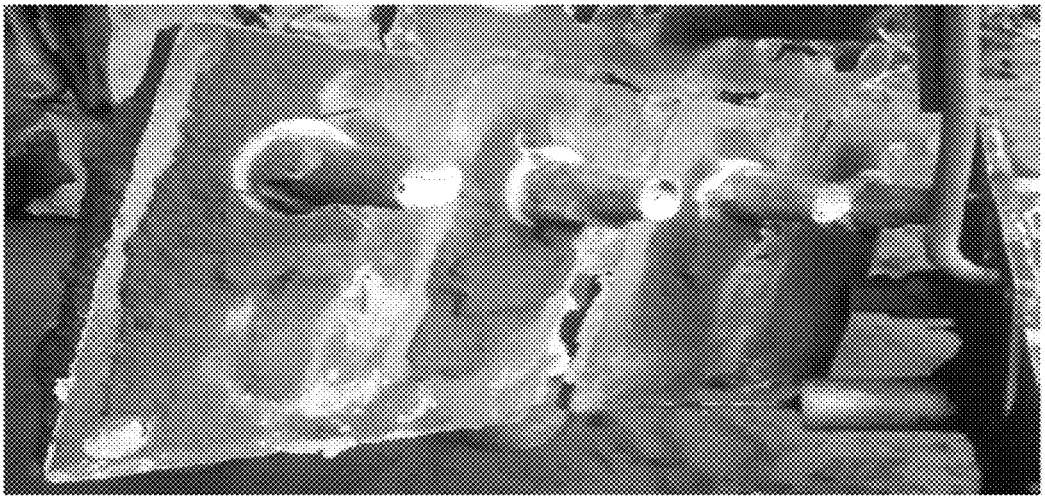
FIG. 14B illustrates a photograph indicating a sand peel property of cast product after a use of carbon impregnated nanoparticle based sand conditioner composition (Cerakarb™) in foundry, according to an embodiment herein.

FIG. 14A illustrates a photograph indicating a sand peel property of a sand peel property of cast product before a use of carbon impregnated nanoparticle based sand conditioner composition (Cerakarb™) in foundry, according to an embodiment herein. FIG. 14B illustrates a photograph indicating a sand peel property of a sand peel property of cast product after a use of carbon impregnated nanoparticle based sand conditioner composition (Cerakarb™) in foundry, according to an embodiment herein. FIG. 14A illustrates the sand on the surface of the metal product made without Cerakarb™ sand mould, whereas FIG. 14B illustrates the clean surface with less sand on the surface of metal product made in Cerakarb™ sand mould.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the embodiments herein with modifications. The scope of the embodiments will be ascertained by the claims to be submitted at the time of filing a complete specification.

What is claimed is:

1. A nanoparticle based sand conditioner composition for foundry industry, the composition comprises:

a raw material compound 1;

a raw material compound 2;

a raw material compound 3; and a raw material compound 4;

wherein the raw material compound 1 comprises a carbonaceous material, a hydrocarbon, an ultrafine metal/metal oxide compound nanoparticles, an ultrafine ceramic oxide nanoparticles and metallic wires, and wherein an amount of carbonaceous material present in the raw material compound 1 is 85-98% w/w, and wherein an amount of hydrocarbon present in the raw material compound 1 is 2-10% w/w, and wherein an amount of ultrafine metal/metal oxide compound nanoparticles present in the raw material compound 1 is 1-10% w/w, and wherein an amount of ultrafine ceramic oxide nanoparticles present in the raw material compound 1 is 1-10% w/w, and wherein an amount of metallic wires present in the raw material compound 1 is 2% w/w;

wherein the raw material compound 2 comprises a carbon source of a natural carbon source, and wherein the natural carbon source is selected from a group consisting of saw dust, coffee husk, rice/paddy husk and tamarind seed husk, and wherein the raw material compound 2 is present in a quantity of more than 70% w/w, and wherein an ash content in the raw material compound 2 is less than 3% w/w, and wherein a moisture content in the raw material compound 2 is less than 5% w/w, and wherein a particle size of raw material compound 2 is in a range of −20 mesh to +100 mesh;

wherein the raw material compound 3 comprises a carbon source of synthetic or non-renewable sources, and wherein the synthetic or non-renewable carbon source is selected from a group consisting of coal dust, graphite, pitch powder and calcined petroleum coke (CPC), and wherein an ash content in the raw material compound 3 is less than 3% w/w, and wherein a volatile matter present in the raw material compound 3 is more than 10% w/w, and wherein a moisture content in the raw material compound 3 is less than 5% w/w; and wherein the raw material compound 4 comprises hydrocarbons, and wherein the hydrocarbons are selected from the group consisting of C5 to C36 compounds, and wherein an ash content in raw material compound 4 is less than 0.05% w/w, and wherein a volatile matter present in the raw material compound 4 is more than 90% w/w, and wherein a moisture content in the raw material compound 4 is less than 5% w/w; and wherein the nanoparticle based sand conditioner composition for foundry industry comprises nanoparticles impregnated into carbon in a sand mould.

2. The composition according to claim 1, wherein the carbonaceous material is selected from a group consisting of a lamp black, and/or a furnace black, and wherein the carbonaceous material comprises a carbon, a hydrogen and an ash, and wherein the amount of carbon present in the carbonaceous material is in a range of 80-95%, and wherein the amount of hydrogen present in the carbonaceous material is in a range of 1.6-3%, and wherein an amount of ash present in the carbonaceous material is 2% w/w, and wherein a particle size of carbonaceous material is less than 1.2 mm, and wherein a softening point of the carbonaceous material is more than 110° C., and wherein an amount of volatile matter present in the carbonaceous material is more than 50% w/w, and wherein a moisture content in the carbonaceous material is less than 8%.

3. The composition according to claim 1, wherein the hydrocarbon is selected from a group consisting of C5 to C36 compounds, and wherein an amount of ash present in the hydrocarbon is less than 0.05% w/w, and wherein an amount of volatile matter present in the hydrocarbon is more than 90% w/w, and wherein an amount of moisture present in the hydrocarbon is less than 5% w/w.

4. The composition according to claim 1, wherein the ultrafine metal/metal oxide compound nanoparticles are selected from a group consisting of $CuFe_2O_4$, $CoFe_2O_4$, $ZnFe_2O_4$, $CuZnFe_2O_4$, $Fe_2O_3$, Gamma $Fe_2O_3$, $Fe_3O_4$, ZnO, and wherein a particle size of the ultrafine metal or metal oxide compound nanoparticles is less than 0.1 microns, and wherein a melting point of ultrafine metal or metal oxide compound nanoparticles is 1000° C.

5. The composition according to claim 1, wherein the ultrafine ceramic oxide nanoparticles are selected from a group consisting of alumina, beryllia, ceria, zirconia, silica/silica fume or fused silica, and wherein a particle size of the ultrafine ceramic oxide nanoparticles is less than 0.1 micron.

6. The composition according to claim 1, wherein an amount of graphene present in the raw material compound 1 is less than 1% w/w, and wherein an amount of volatile matter present in the raw material compound 1 is less than 15% w/w, and wherein a carbon component of carbonaceous material has a structure similar to graphite with covalent bonds, and wherein the carbon component is impregnated with the nano-ceramic oxides and nano metal oxides, and wherein an amount of ash present in the raw material compound 1 is 30% w/w, specifically the amount of ash is present in the raw material compound 1 in the range of 9-16% w/w, and wherein the raw material compound 1 exhibits flow-ability at a temperature of 926° C.

7. The composition according to claim 1, wherein a molecular composition of raw material compound 1 comprises a carbon, a hydrogen, a nitrogen, an oxygen, a silica, a zinc, an iron, a titanium, an aluminum, a sodium, a potassium, a magnesium, and copper, and wherein the carbon is present in the molecular composition of raw material compound 1 in a quantity of 80-88%, and wherein the hydrogen is present in the molecular composition of raw material compound 1 in a quantity of 1.5-2%, and wherein the nitrogen is present in the molecular composition of raw material compound 1 in a quantity of 0.3-0.4%, and wherein the oxygen is present in the molecular composition of raw material compound 1 in a quantity of less than 3%, and wherein the silica is present in the molecular composition of raw material compound 1 in a quantity of less than 3%, and wherein the zinc is present in the molecular composition of raw material compound 1 in a quantity of 3-4%, and wherein the iron is present in the molecular composition of raw material compound 1 in a quantity of 3-5%, and wherein titanium, aluminum, sodium, potassium, magnesium, and copper together are present in the molecular composition of raw material compound 1 in a quantity less than 2%.

8. The composition according to claim 1, wherein the metallic wires are made from the metals or alloys selected from a group consisting of iron, alloys of iron, steel or alloys of steel, and wherein the metallic wires have a diameter in a range of 0-1.2 mm, and wherein the metallic wires have a length in a range of 0-3 mm, and wherein the metallic wires form an intermediate compound, and wherein the intermediate compound comprises carbon particles, metal particles and ceramic particles.

9. A method of synthesizing a nanoparticle based sand conditioner composition for foundry industry, the method comprises the steps of:

synthesizing a raw material compound 1;

mixing a raw material compound 2 and a raw material compound 4 in a mixer;

mixing the raw material compound 2 and the raw material compound 4 for 10 minutes until the raw material compound 4 is uniformly coated over raw material compound 2 to obtain an intermediate product;

mixing the raw material compound 1, and a raw material compound 3 to the intermediate product in a mixer for 10 minutes to obtain a uniform mixture;

obtaining a nanoparticle based sand conditioner composition for foundry industry, and wherein the nanoparticle based sand conditioner composition for foundry industry comprises nanoparticles impregnated into carbon in a sand mould; and packaging or bagging the nanoparticle based sand conditioner composition for foundry industry;

wherein the raw material compound 1 comprises a carbonaceous material, a hydrocarbon, an ultrafine metal/metal oxide compound nanoparticles, an ultrafine ceramic oxide nanoparticles and metallic wires, and wherein an amount of carbonaceous material present in the raw material compound 1 is 85-98% w/w, and wherein an amount of hydrocarbon present in the raw material compound 1 is 2-10% w/w, and wherein an amount of ultrafine metal/metal oxide compound nanoparticles are present in the raw material compound 1 is 1-10% w/w, and an amount of ultrafine ceramic oxide nanoparticles present in the raw material compound 1 is 1-10% w/w, and wherein an amount of metallic wires present in the raw material compound 1 is 2% w/w; and wherein the raw material compound 2 comprises a carbon source of a natural carbon source, and wherein the natural carbon source is selected from a group consisting of saw dust, coffee husk, rice/paddy husk and tamarind seed husk; and wherein the raw material compound 3 comprises a carbon source of a synthetic carbon source or non-renewable carbon source, and wherein the synthetic or non-renewable carbon source is selected from a group consisting of coal dust, graphite, pitch powder and calcined petroleum coke (CPC); and wherein the raw material compound 4 comprises hydrocarbons, and wherein the hydrocarbons are selected from a group consisting of C5 to C36 compounds.

10. The method according to claim 9, wherein the method of synthesizing the raw material compound 1 comprises the steps of:

mixing the carbonaceous material, the hydrocarbon, the ultrafine metal/metal oxide compound nanoparticles, an ultrafine ceramic oxide nanoparticles and metal wires to obtain a mixture;

heating the mixture at a temperature of 200-500° C. with constant agitation for 1 hour in a reactor;

maintaining the temperature of the heated mixture for 8-24 hours with constant agitation in the reactor, and wherein a pressure is maintained in a range of 0.3 bar to 45 bar;

terminating the reaction after 8-24 hours by stopping heat supply;

passing air at an ambient temperature through the mixture in the reactor and continuing the agitation of reactor with the mixture to cool the mixture to a room temperature or a temperature of 50° C. to obtain the raw material compound 1; and packaging or bagging the raw material compound 1.

11. The method according to claim 9, wherein the carbonaceous material is selected from a group consisting of a lamp black, and/or a furnace black, and wherein a particle size of carbonaceous material is less than 1.2 mm, and wherein a softening point of the carbonaceous material is more than 110° C., and wherein an amount of volatile matter present in the carbonaceous material is more than 50% w/w, and wherein a moisture content in the carbonaceous material is less than 8%, and wherein the carbonaceous material comprises carbon, hydrogen and ash, and wherein an amount of carbon present in the carbonaceous material is in a range of 80-95%, and wherein an amount of hydrogen present in the carbonaceous material is in a range of 1.6-3%, and wherein an amount of ash present in the carbonaceous material is 2% w/w.

12. The method according to claim 9, wherein an amount of ash present in the hydrocarbon is less than 0.05% w/w, and wherein an amount of volatile matter present in the hydrocarbon is more than 90% w/w, and wherein an amount of moisture present in the hydrocarbon is less than 5% w/w.

13. The method according to claim 9, wherein the ultrafine metal/metal oxide compound nanoparticles are selected from a group consisting of $CuFe_2O_4$, $CoFe_2O_4$, $ZnFe_2O_4$, $CuZnFe_2O_4$, $Fe_2O_3$, Gamma $Fe_2O_3$, $Fe_3O_4$, ZnO, and wherein a particle size of the ultrafine metal or metal oxide compound nanoparticles is less than 0.1 microns, and wherein a melting point of ultrafine metal or metal oxide compound nanoparticles is 1000° C.

14. The method according to claim 9, wherein the ultrafine ceramic oxide nanoparticles are selected from a group consisting of alumina, beryllia, ceria, zirconia, silica/silica fume or fused silica, and wherein a particle size of the ultrafine ceramic oxide nanoparticles is less than 0.1 micron.

15. The method according to claim 9, wherein an amount of graphene present in the raw material compound 1 is less than 1% w/w, and wherein an amount of volatile matter present in the raw material compound 1 is less than 15% w/w, and wherein a carbon component of the carbonaceous material has a structure similar to graphite with covalent bonds, and wherein the carbon component is impregnated with the nano-ceramic oxides and nano metal oxides, and wherein an amount of ash present in the raw material compound 1 is 30% w/w, specifically the ash is present in the range of 9-16% w/w, and wherein the raw material compound 1 exhibits flow-ability at a temperature of 926° C.

16. The method according to claim 9, wherein a molecular composition of raw material compound 1 comprises a carbon, a hydrogen, a nitrogen, an oxygen, a silica, a zinc, an iron, a titanium, an aluminum, a sodium, a potassium, a magnesium, and copper, and wherein the carbon is present in the molecular composition of raw material compound 1 in a quantity of 80-88%, and wherein hydrogen is present in the molecular composition of raw material compound 1 in a quantity of 1.5-2%, and wherein nitrogen is present in the molecular composition of raw material compound 1 in a quantity of 0.3-0.4%, and wherein oxygen is present in the molecular composition of raw material compound 1 in a quantity of less than 3%, and wherein silica is present in the molecular composition of raw material compound 1 in a quantity of less than 3%, and wherein zinc is present in the molecular composition of raw material compound 1 in a quantity of 3-4%, and wherein the iron is present in the molecular composition of raw material compound 1 in a quantity of 3-5%, and wherein titanium, aluminum, sodium, potassium, magnesium, and copper together are present in the molecular composition of raw material compound 1 in a quantity less than 2%.

17. The method according to claim 9, wherein the metallic wires are made from the metals or alloys selected from a group consisting of IA iron, alloys of iron, steel or alloys of steel, and wherein the metallic wires have a diameter in a range of 0-1.2 mm, and wherein the metallic wires have a length in a range of 0-3 mm, and wherein the metallic wires form an intermediate compound, and wherein the intermediate compound comprises carbon particles, metal particles and ceramic particles.

18. The method according to claim 9, wherein the raw material compound 2 is present in a quantity of more than 70% w/w, and wherein an amount of ash present in the raw material compound 2 is less than 3% w/w, and wherein an amount of moisture present in the raw material compound 2 is less than 5% w/w, and wherein an amount of ash present in the raw material compound 2 is less than 3% w/w, and wherein the particle size for raw material compound 2 is within a range of −20 mesh to +100 mesh.

19. The method according to claim 9, wherein an amount of ash present in the raw material compound 3 is less than 3% w/w, and wherein an amount of volatile matter present in the raw material compound 3 is more than 10% w/w, and wherein an amount of moisture content present in the raw material compound 3 is less than 5% w/w.

20. The method according to claim 9, wherein an amount of ash present in the raw material compound 4 is less than 0.05% w/w, and wherein an amount of volatile matter present in the raw material compound 4 is more than 90% w/w, and wherein an amount of moisture content present in the raw material compound 4 is less than 5% w/w.

* * * * *